US010811179B2

(12) United States Patent
Abe et al.

(10) Patent No.: US 10,811,179 B2
(45) Date of Patent: Oct. 20, 2020

(54) COIL COMPONENT

(71) Applicant: TOKIN CORPORATION, Sendai-shi, Miyagi (JP)

(72) Inventors: Yuki Abe, Sendai (JP); Takashi Yanbe, Sendai (JP); Takuya Endou, Sendai (JP); Hidehiko Oikawa, Sendai (JP); Masahiro Kondo, Sendai (JP); Keisuke Akaki, Sendai (JP)

(73) Assignee: TOKIN CORPORATION, Miyagi (JP)

( * ) Notice: Subject to any disclaimer, the term of this patent is extended or adjusted under 35 U.S.C. 154(b) by 378 days.

(21) Appl. No.: 15/750,486

(22) PCT Filed: Aug. 5, 2016

(86) PCT No.: PCT/JP2016/073162

§ 371 (c)(1),
(2) Date: Feb. 5, 2018

(87) PCT Pub. No.: WO2017/033711

PCT Pub. Date: Mar. 2, 2017

(65) Prior Publication Data

US 2019/0019607 A1 Jan. 17, 2019

(30) Foreign Application Priority Data

Aug. 24, 2015 (JP) ..... 2015-164925

(51) Int. Cl.
*H01F 17/04* (2006.01)
*H01F 3/10* (2006.01)
(Continued)

(52) U.S. Cl.
CPC ..... *H01F 17/04* (2013.01); *H01F 1/14* (2013.01); *H01F 3/08* (2013.01); *H01F 3/10* (2013.01);
(Continued)

(58) Field of Classification Search
CPC ..... H01F 17/04; H01F 27/24; H01F 37/00; H01F 2017/046; H01F 1/14;
(Continued)

(56) References Cited

U.S. PATENT DOCUMENTS 6,392,525 B1 * 5/2002 Kato ..... H01F 3/08 336/200
6,888,435 B2 * 5/2005 Inoue ..... H01F 1/24 336/83
(Continued)

FOREIGN PATENT DOCUMENTS

CN 202839232 U 3/2013
JP 2001185421 A 7/2001
(Continued)

OTHER PUBLICATIONS

Chinese Office Action (and English language translation thereof) dated Dec. 26, 2018 issued in counterpart Chinese Application No. 201680048063.1.
(Continued)

*Primary Examiner* — Tszfung J Chan
(74) *Attorney, Agent, or Firm* — Holtz, Holtz & Volek PC

(57) ABSTRACT

A coil component includes a coil having inner and outer circumferential surfaces, a pair of end surfaces, and a core surrounding at least a part of a periphery of the core. A cross section is where the coil component is cut by a plane, when each of coil sections is divided into eight regions by four straight lines extending along the inner circumferential surface, the outer circumferential surface and the end surfaces. In the cross section, first core members positioned at four corner regions, second core members positioned at an inner side of the inner circumferential surface and an outer side of the outer circumferential surface, and third core members, positioned at outer sides of the end surfaces form the core. At least one of the second and third core members
(Continued)

has a magnetic permeability lower than that of the first core member in a zero magnetic field.

13 Claims, 24 Drawing Sheets

(51) Int. Cl.

| | |
|---|---|
| ***H01F 27/24*** | (2006.01) |
| ***H01F 37/00*** | (2006.01) |
| ***H01F 1/14*** | (2006.01) |
| ***H01F 3/08*** | (2006.01) |
| ***H01F 27/30*** | (2006.01) |
| *H01F 3/14* | (2006.01) |

(52) U.S. Cl.
CPC ..... *H01F 27/24* (2013.01); *H01F 27/306* (2013.01); *H01F 37/00* (2013.01); *H01F 3/14* (2013.01); *H01F 2003/106* (2013.01); *H01F 2017/046* (2013.01); *H01F 2017/048* (2013.01)

(58) Field of Classification Search
CPC .... H01F 27/306; H01F 2017/048; H01F 3/08; H01F 2003/106
USPC ..... 336/200, 232
See application file for complete search history.

(56) References Cited

U.S. PATENT DOCUMENTS

| | | | | |
|---|---|---|---|---|
| 7,449,984 | B2 * | 11/2008 | Kawarai | H01F 17/043 336/83 |
| 8,988,177 | B1 | 3/2015 | Dai et al. | |
| 2012/0218066 | A1 * | 8/2012 | Inaba | H01F 37/00 336/83 |
| 2012/0313740 | A1 * | 12/2012 | Inaba | H01F 37/00 336/61 |

FOREIGN PATENT DOCUMENTS

| | | | |
|---|---|---|---|
| JP | 2011138939 | A | 7/2011 |
| JP | 2012089899 | A | 5/2012 |
| JP | 2013179264 | A | 9/2013 |
| JP | 2015159144 | A | 9/2015 |
| JP | 2016207992 | A | 12/2016 |

OTHER PUBLICATIONS

International Search Report (ISR) dated Oct. 18, 2016 issued in International Application No. PCT/JP2016/073162.
Written Opinion dated Oct. 18, 2016 issued in International Application No. PCT/JP2016/073162.
Japanese Office Action dated Nov. 14, 2018 (and English translation thereof) issued in counterpart Japanese Application No. 2015-164925.

* cited by examiner

COIL COMPONENT

TECHNICAL FIELD

This invention relates to a coil component which is provided with a core and a coil embedded in the core.

BACKGROUND ART

Patent Document 1 discloses a reactor (a coil component) of this type, for example. Moreover, Patent Document 2 discloses a core for a reactor, but a different type, which is formed by combining core members having different relative magnetic permeabilities.

The reactor disclosed in Patent Document 1 is provided with a first core portion, a coil arranged at the outside of the first core portion, a second core portion arranged at the outside of the coil and coupling core portions coupling the first and the second core portions to each other to cover both end surfaces of the coil. The second core portion has a maximum magnetic permeability larger than that of the first core portion.

The core for the reactor disclosed in Patent Document 2 is provided with a pair of coil arrangement portions which are covered with coils and a pair of exposed portions which are not covered with the coils. The exposed portions are formed to have a relative magnetic permeability higher than that of the coil arrangement portions.

PRIOR ART DOCUMENTS

Patent Document(s)

Patent Document 1: JPA2011-138939
Patent Document 2: JPA2012-089899

SUMMARY OF INVENTION

Technical Problem

A coil component such as a reactor for a car needs providing a magnetic resistance portion in a magnetic circuit to avoid being caused magnetic saturation. The magnetic resistance portion, however, has a problem that it causes a magnetic flux leak to increase alternating current copper loss. Neither Patent Document 1 nor Patent Document 2 discloses alternating current copper loss depending on a magnetic flux leak from a magnetic resistance portion.

Therefore, an object of the present invention is to provide a coil component which can reduce alternating current copper loss depending on a magnetic flux leak from a magnetic resistance portion.

Solution to Problem

A first aspect of the present invention provides, as a first coil component, a coil component which includes a coil having an inner circumferential surface, an outer circumferential surface and a pair of end surfaces continuous with the inner circumferential surface and the outer circumferential surface; and a core surrounding at least a part of a periphery of the core. In a cross section obtained by cutting the coil component by a plane including a winding axis of the coil and a magnetic path making a circuit in the core, when a vicinity of each of coil sections is divided into eight regions by four straight lines extending along the inner circumferential surface, the outer circumferential surface and the end surfaces, following are provided as the core, first core members which are disposed in four of the regions positioned at corners, respectively, second core members which are disposed in two of the regions positioned at an inner side of the inner circumferential surface and at an outer side of the outer circumferential surface, respectively, and third core members which are disposed in two of the regions positioned at outer sides of the end surfaces, respectively. At least one of the second core member and the third core member has a magnetic permeability lower than that of the first core member in a zero magnetic field.

A second aspect of the present invention provides, as a second coil component, a coil component which is the first coil component. The second core member has a magnetic permeability lower than that of the first core member in a zero magnetic field. At least a part of the third core member is made of a material identical to that of the second core member.

A third aspect of the present invention provides, as a third coil component, a coil component which is the first coil component. The second core member has a magnetic permeability lower than that of the first core member in a zero magnetic field. The third core member is made of a material identical to that of the first core member.

A fourth aspect of the present invention provides, as a fourth coil component, a coil component which is the first or the third coil component. A nonmagnetic gap is inserted into the second core member disposed at the inner side of the inner periphery of the coil.

A fifth aspect of the present invention provides, as a fifth coil component, a coil component which is any one of the second to the forth coil component. At least a part of the third core member is replaced by a nonmagnetic gap.

A sixth aspect of the present invention provides, as a sixth coil component, a coil component which is any one of the second to the fifth coil component. The coil is an edgewise coil into which a flat wire is wound in a helical fashion.

A seventh aspect of the present invention provides, as a seventh coil component, a coil component which is the sixth coil component. The flat wire has a thickness greater than a skin depth.

An eighth aspect of the present invention provides, as an eighth coil component, a coil component which is the sixth or the seventh coil component. The coil is smaller than or equal to 10 in number of winding rows thereof.

A ninth aspect of the present invention provides, as a ninth coil component, a coil component which is the eighth coil component. The coil is smaller than or equal to 2 in number of the winding rows.

A tenth aspect of the present invention provides, as a tenth coil component, a coil component which is the eighth coil component. The first core member is a dust core, and the second core member is a thing obtained by hardening mixture including a magnetic substance and a resin.

An eleventh aspect of the present invention provides, as an eleventh coil component, a coil component which is the first coil component. The third core member has a magnetic permeability lower than that of the first core member in a zero magnetic field. At least a part of the second core member is made of a material identical to that of the third core member.

A twelfth aspect of the present invention provides, as a twelfth coil component, a coil component which is the first coil component. The third core member has a magnetic permeability lower than that of the first core member in a zero magnetic field. The second core member is made of a material identical to that of the first core member.

A thirteenth aspect of the present invention provides, as a thirteenth coil component, a coil component which is the eleventh or the twelfth coil component. The coil is a flatwise coil into which a flat wire is wound in a spiral fashion.

Advantageous Effects of Invention

In a cross section obtained by cutting a coil component by a plane including a winding axis of the coil and a magnetic path making a circuit in the core, the vicinity of each of coil sections is divided into eight regions, and first core members are respectively disposed in the four regions positioned at the corners thereof. Moreover, second core members are disposed in the region positioned at an inner side of an inner circumferential surface and the region positioned at an outer side of an outer circumferential surface, respectively, and third core members are disposed in the regions positioned at outer sides of end surfaces, respectively. Then, for at least one of the second core member and the third core member, a core member having a magnetic permeability lower than that of the first core member at a zero magnetic field is used. With this structure, a magnetic flux leak to the coil can be reduced, and alternating current copper loss can be reduced.

An appreciation of the objectives of the present invention and a more complete understanding of its structure may be had by studying the following description of the preferred embodiment and by referring to the accompanying drawings.

DESCRIPTION OF EMBODIMENTS

Figure 1:
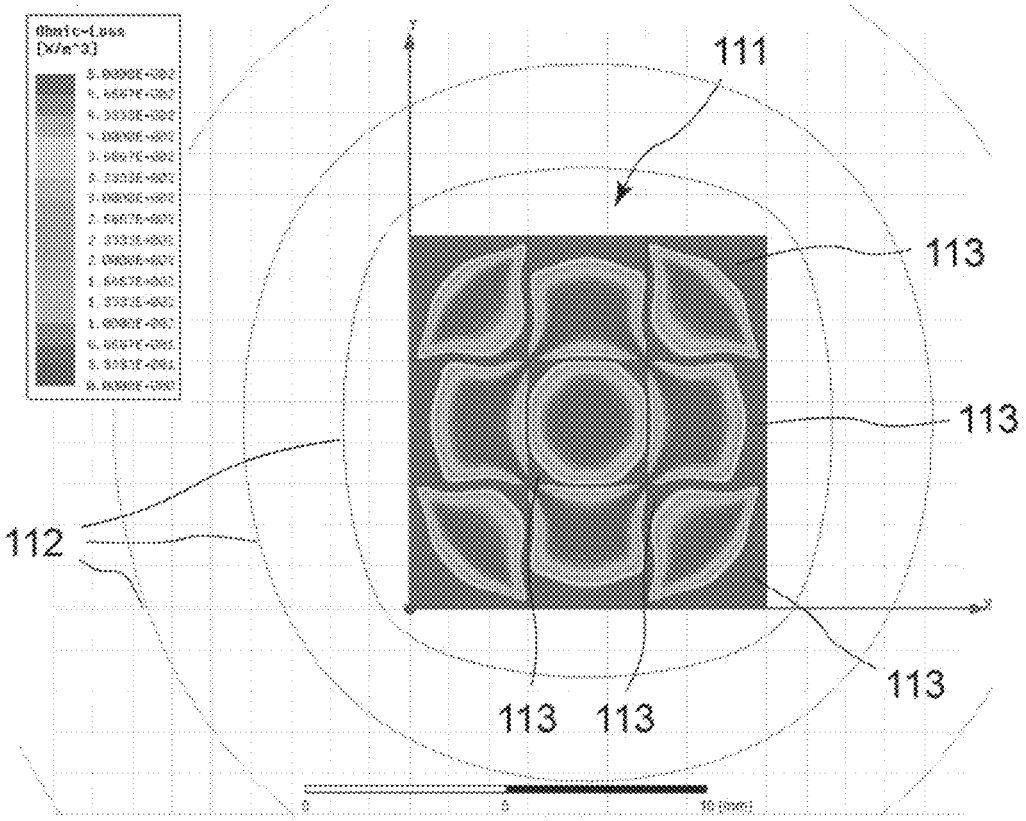
FIG. 1 is a diagram showing, in conjunction with magnetic fluxes, a distribution of alternating current copper loss caused by energization in a coil into which a square wire is wound.

While the invention is susceptible of various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

For understanding the present invention, first, the description is made about matters studied by the inventors. The skin effect and the proximity effect are known as major causes of alternating current copper loss caused in a coil. Here, the skin effect becomes larger as a frequency of a current flowing in the coil becomes high. In addition, the proximity effect caused by an interaction with adjacent conductors also becomes a problem. Therefore, the inventors studied about reduction of the alternating current copper loss.

A coil component such as a reactor has a coil and a core. The core can become a cause of causing the proximity effect to the coil. When a thing having a relatively high magnetic permeability is used as the core, a magnetic flux leak from the core to the coil can be reduced, and the proximity effect caused by the core can be suppressed. In a case of trying to obtain desired inductance characteristics and magnetic saturation characteristics for a coil component, however, it is necessary to provide a magnetic resistance portion in a magnetic circuit. Then, the magnetic resistance portion becomes a cause of increase of alternating current resistance loss depending on the magnetic flux leak from the core to the coil. Additionally, as the magnetic resistance portion, there is a nonmagnetic material gap or a core member having a relatively low magnetic permeability. The magnetic flux leak that is caused by the non-magnetic material gap is caused in the vicinity of the gap in a concentrated manner.

In order to know influence of a magnetic flux leak from a magnetic resistance portion to a coil, the inventors first studied about influence of an outer magnetic field to the coil. Simulations were carried out using a square wire (FIG. 1 and FIG. 2) or a flat wire (FIG. 3 to FIG. 6) as a winding wire for the coil in each of the simulations. Regarding the flat wire, two kinds of winding systems, flatwise (FIG. 3 and FIG. 4) in which a flat wire was wound in a spiral pattern so that long sides of its cross section are parallel to a winding axis and edgewise (FIG. 5 and FIG. 6) in which a flat wire was wound in a helical fashion so that long sides of its cross section are perpendicular to a winding axis, were adopted. In each of FIGS. 1 to 6, the winding axis extends in an up-down direction to be positioned in a left side of the coil. In other words, each of FIGS. 1 to 6 shows one of two cross sections, and the vicinity thereof, of the coil seen in a case where the coil is cut by a plane including its winding axis.

Figure 2:
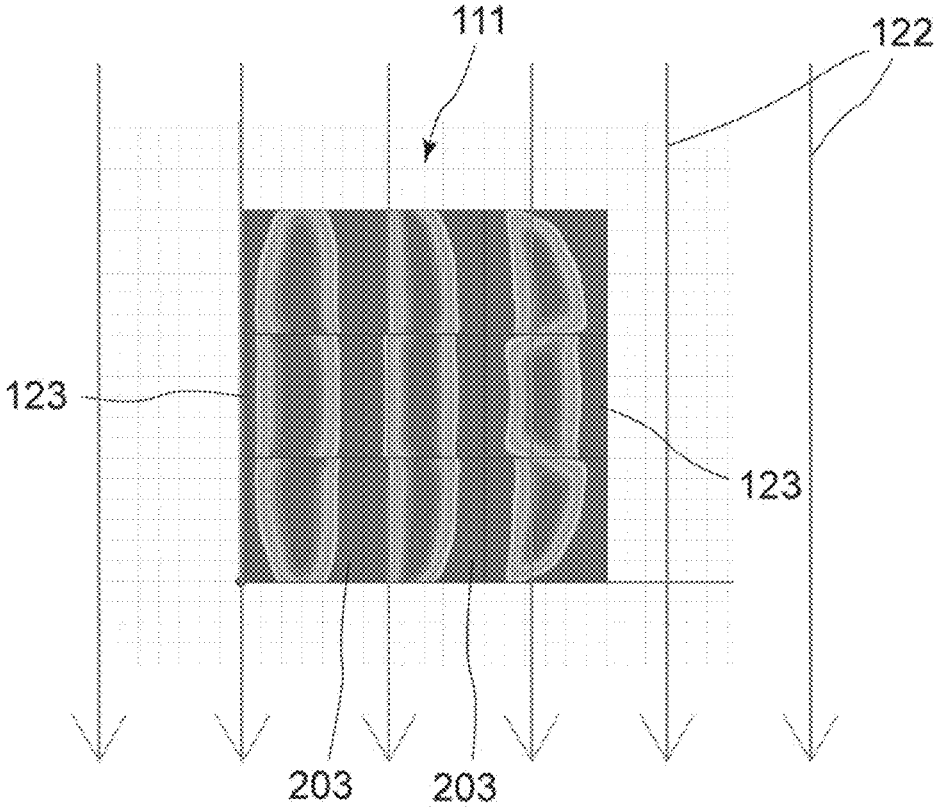
FIG. 2 is a diagram showing, in conjunction with magnetic fluxes, a distribution of alternating current copper loss caused by energization in a case where the coil of FIG. 1 is placed in an outer magnetic field of a vertical direction.

Referring to FIG. 1, a magnetic field depicted by concentric magnetic fluxes 112 is caused by energization to a coil 111 into which a square wire is wound in 3 layers by 3 rows. In this situation, a large alternating current copper loss region(s) 113 is (are) mainly formed in a far side(s), which is far from a center of the magnetic field, of each square wire. On the other hand, when the same coil 111 is placed in an outer magnetic field (vertical magnetic field) represented by magnetic fluxes 122 in FIG. 2, large alternating current copper loss regions 123 appear in both sides of each row (up-down direction) formed by the square wires. In addition, the regions 123 of FIG. 2 are different from the regions 113 of FIG. 1 in distribution. It should be noted that, in the present description, a row of conducting wires in a direction perpendicular to the winding axis of the coil is referred to as "layer" and a row of the conducting wires in a direction parallel to the winding axis of the coil is referred to as "row (or winding row)". Furthermore, though a magnetic field in the direction extending along the winding axis is referred to as "vertical magnetic field" for the sake of expediency in the present description, the winding axis may be oriented in any direction. "Vertical" does not mean a direction of the gravity.

Figure 3:
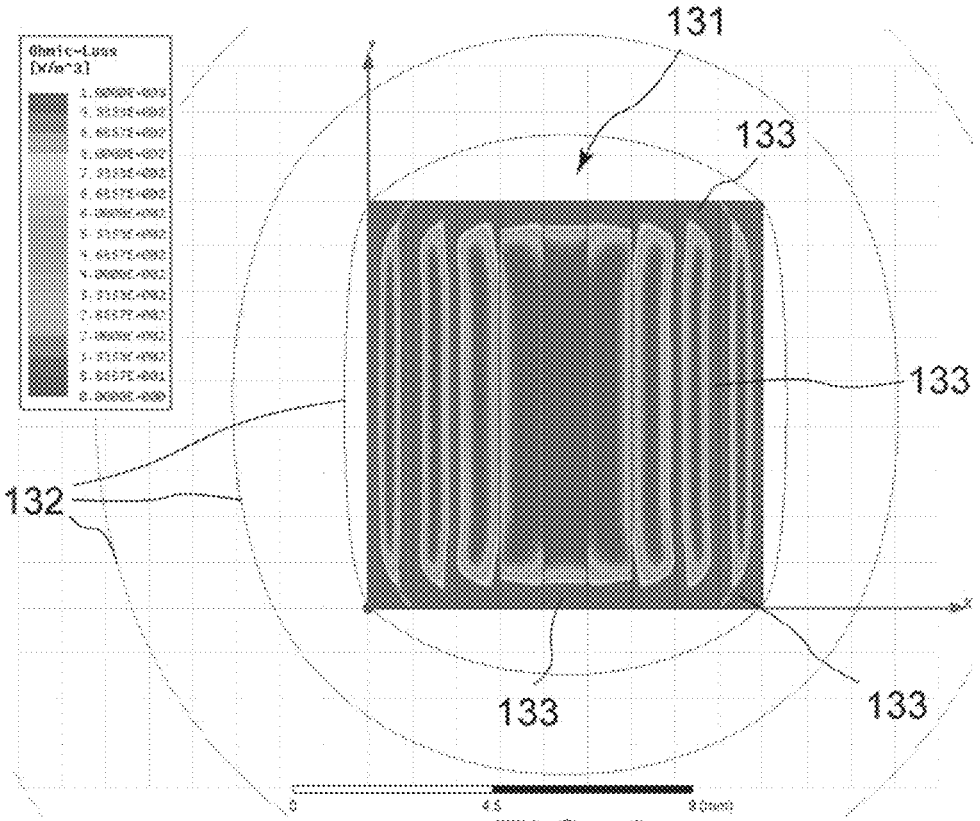
FIG. 3 is a diagram showing, in conjunction with magnetic fluxes, a distribution of alternating current copper loss caused by energization in a coil (a flatwise coil) into which a flat wire is wound in a scroll pattern so that long sides of its cross section are parallel to a winding axis.
Figure 4:
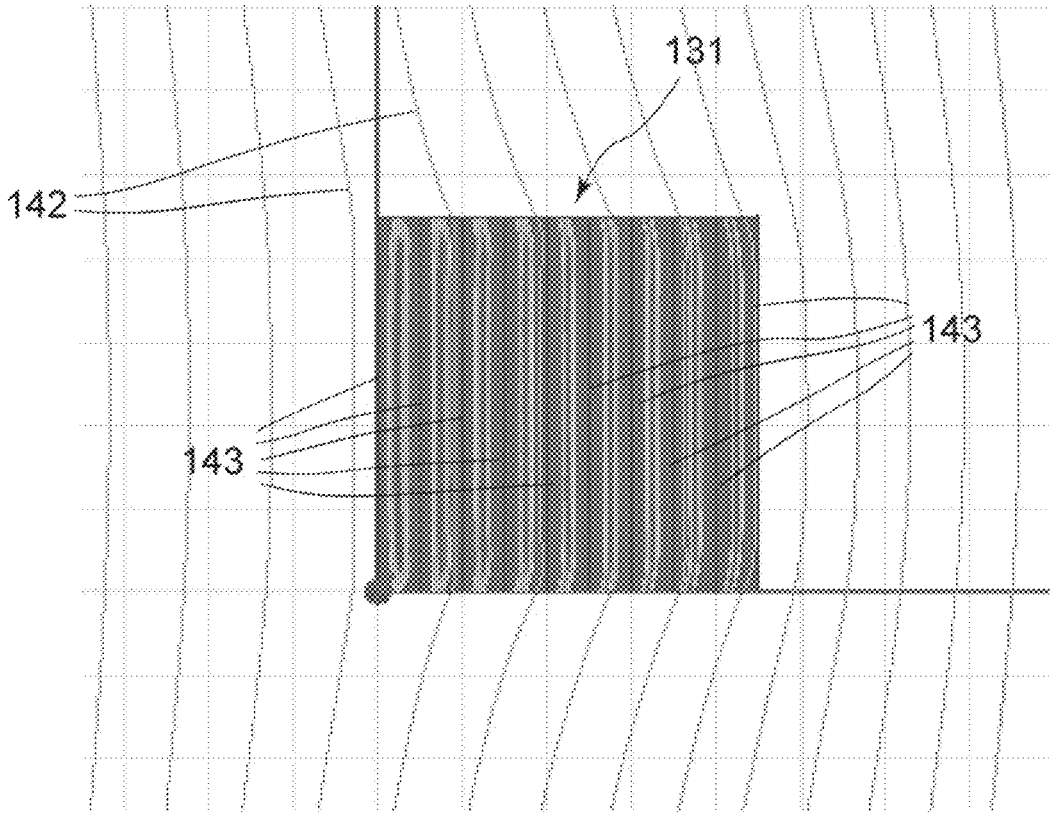
FIG. 4 is a diagram showing, in conjunction with magnetic fluxes, a distribution of alternating current copper loss caused by energization in a case where the coil of FIG. 3 is placed in an outer magnetic field of a vertical direction.

Referring to FIG. 3, a magnetic field depicted by concentric magnetic fluxes 132 is caused by energization to a coil 131 into which a flat wire is wound in 9 rows. In this situation, large alternating current copper loss regions 133 appear along short sides of a cross section in each flat wire positioned at a middle portion of the coil 131. Moreover, the large alternating current copper loss regions 133 appear along not only the short sides but also long sides of the cross section in each flat wire positioned at both right and left portions (an outer peripheral side and an inner peripheral side) of the coil 131. When the same coil 131 is placed in an alternating outer magnetic field (vertical magnetic field) extending along the winding axis as shown in FIG. 4, magnetic fluxes 142 representing the outer magnetic field are bent to pass through the coil. Large alternating current copper loss regions 143 extend along both the short sides and the long sides of the cross section of each of all flat wires including the flat wires positioned at the middle portion of the coil 131.

Figure 5:
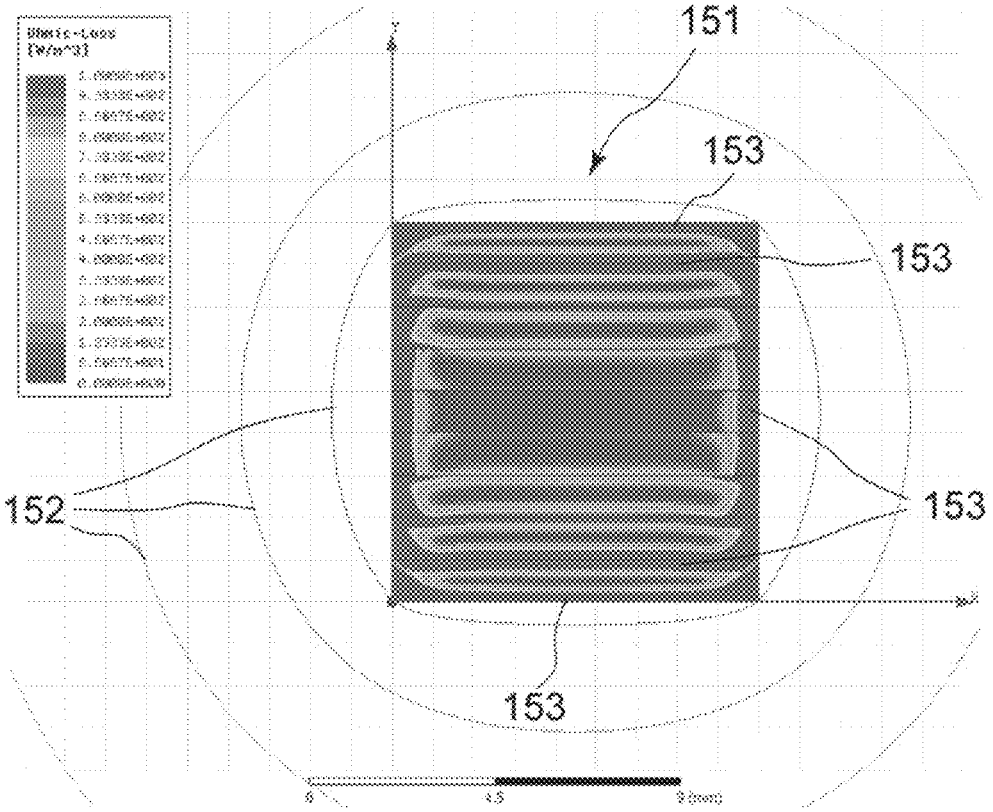
FIG. 5 is a diagram showing, in conjunction with magnetic fluxes, a distribution of alternating current copper loss caused by energization in a coil (an edgewise coil) into which a flat wire is wound so that long sides of its cross section are perpendicular to a winding axis.
Figure 6:
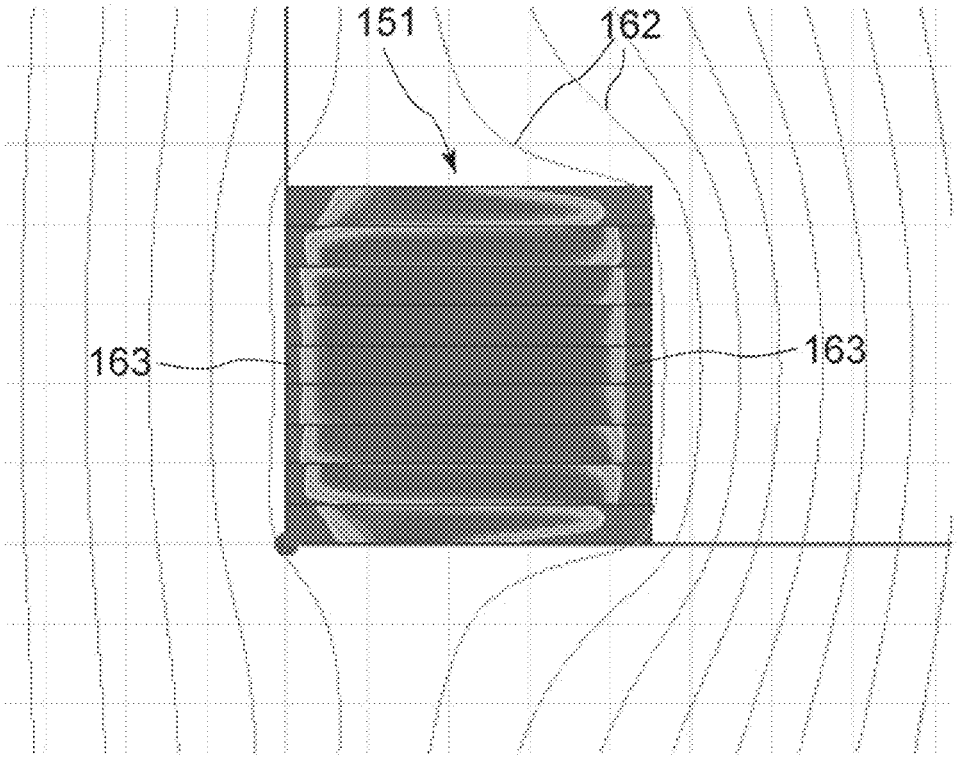
FIG. 6 is a diagram showing, in conjunction with magnetic fluxes, a distribution of alternating current copper loss caused by energization in a case where the coil of FIG. 5 is placed in an outer magnetic field of a vertical direction.

Referring to FIG. 5, a magnetic field depicted by concentric magnetic fluxes 152 is caused by energization to a coil 151 into which a flat wire is wound in 9 layers. In this situation, similarly to the coil 131, large alternating current copper loss regions 153 appear. In other words, in the middle portion of the coil 151, the large alternating current copper loss regions 153 appear along short sides of a cross section of the flat wire. Moreover, in each of upper and lower side portions of the coil 151, the large alternating current copper loss regions 153 appear along the short sides of each flat wire and further appear along long sides of each flat wire. However, when the same coil 151 is placed in an outer magnetic field (vertical magnetic field) extending along the winding axis, magnetic fluxes 162 of the outer magnetic field are bent to avoid the coil 151. The large alternating current copper loss regions 163 are reduced to regions extending along the short sides of the cross section of each flat wire and disappear in regions extending along the long sides.

From FIGS. 1 to 6, the followings can be understood. The magnetic flux is hard to pass through a winding wire (conductor) and easy to pass along a surface of the winding wire or a boundary between the winding wires. In the boundary between the winding wires, easiness of making the magnetic flax pass through differs according to a direction in which the boundary extends. In detail, when a direction of a magnetic field is parallel to a direction in which the boundary extends (FIG. 4), the magnetic flux is easy to pass through the boundary between the winding wires. When the direction of the magnetic field is perpendicular to the direction in which the boundary extends (FIG. 6), the magnetic flux is hard to pass through the boundary between the winding wires.

Form the above, it is presumed that entering (leak) of the magnetic flux into the coil can be suppressed or prevented by controlling the direction of the magnetic field in the vicinity of the coil and thereby suppressing alternating current resistance loss which is due to the core.

Next, the inventors studied about variation of a magnetic field in a case where a core is arranged in the vicinity of a coil in order to control a direction of the magnetic field in the vicinity of the coil. First, studies were carried out about variation of magnetic fluxes in a case where a conducting wire is one in number and a core is arranged in a magnetic field formed when a current is fed through the conducting wire.

Figure 7A:
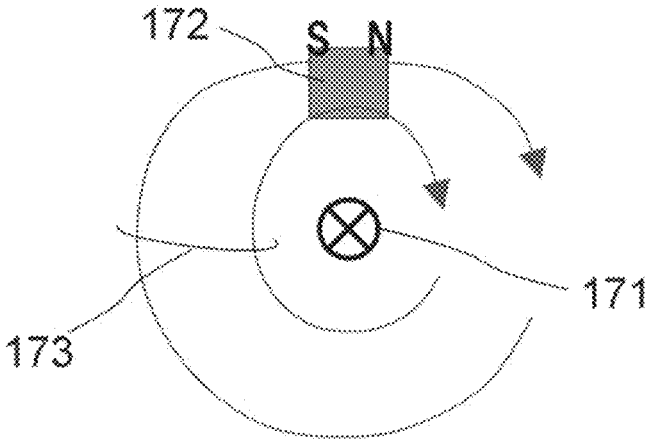
FIG. 7(*a*) is a diagram showing a magnetic field (magnetic fluxes) caused by energization in a case where a core having a cross sectional shape of an approximate square is arranged in the vicinity of a single conducting wire, and FIG. 7(*b*) is a partial, enlarged view thereof.
Figure 7B:
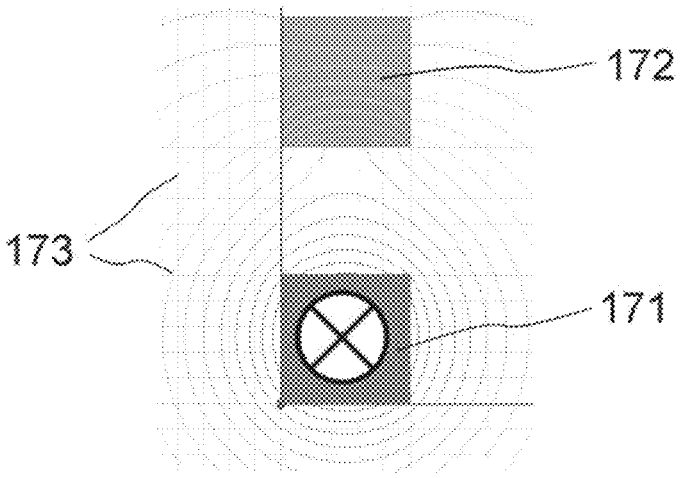
Figure 8:
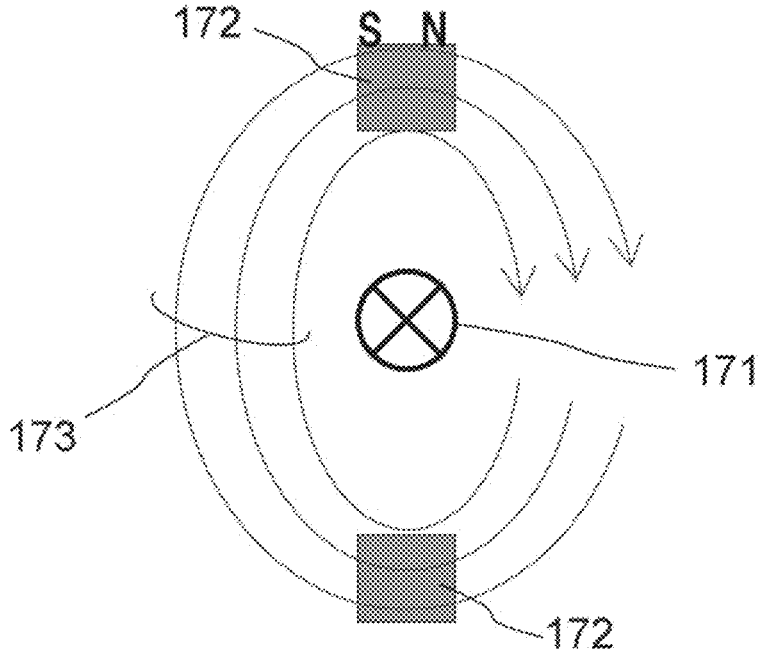
FIG. 8 is a diagram showing a magnetic field (magnetic fluxes) caused by energization in a case where a pair of cores each of which has a cross sectional shape of an approximate square is arranged in the vicinity of a single conducting wire.
Figure 9:
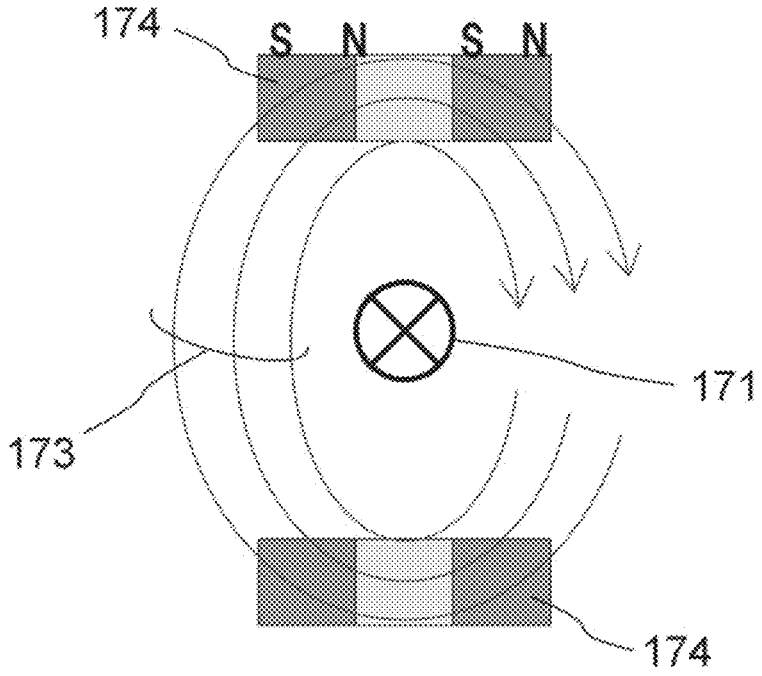
FIG. 9 is a diagram showing a magnetic field (magnetic fluxes) caused by energization in a case where a different pair of cores different from the cores of FIG. 8 in structure is arranged in the vicinity of a single conducting wire.

In the case where the conducting wire is one in number, the magnetic field formed by feeding the current through the conducting wire becomes concentric around the conducting wire in a plane including a cross section perpendicular to a length direction of the conducting wire. When a core is arranged in the magnetic field, magnetic fluxes tend to pass through the core having high magnetic permeability to vary a magnetic flux distribution. As shown in FIGS. 7(*a*) and 7(*b*), it is assumed that a core 172 having a cross section of an approximately square shape is arranged in a magnetic field formed by a conducting wire 171. In such a case, magnetic fluxes 173 tend to pass through a path having high magnetic permeability, i.e. pass through the core 172. However, a length of the core 172 is relatively short in a right-left direction (a direction perpendicular to a straight line connecting the conducting wire 171 to a center of the core 172). Accordingly, the magnetic fluxes 173 are still approximately concentric, and the magnetic flux distribution in the vicinity of the conducting wire 171 cannot be varied largely. As shown in FIG. 8, this is the same in a case where a pair of cores 172 is arranged above and below a conducting wire 171 to be opposed to each other with the conducting wire 171 interposed therebetween. Moreover, as shown in FIG. 9, this is the same in a case where a pair of cores 174 each of which is formed by sandwiching a different core member having lower magnetic permeability between two relatively short core members is arranged to be opposed to each other with the conducting wire 171 interposed therebetween. However, it is conceivable that relative shortness of a length of the core 174 in a right-left direction of the figure and relative wideness of an interval between the cores 174 are also concerned with this case.

Figure 10A:
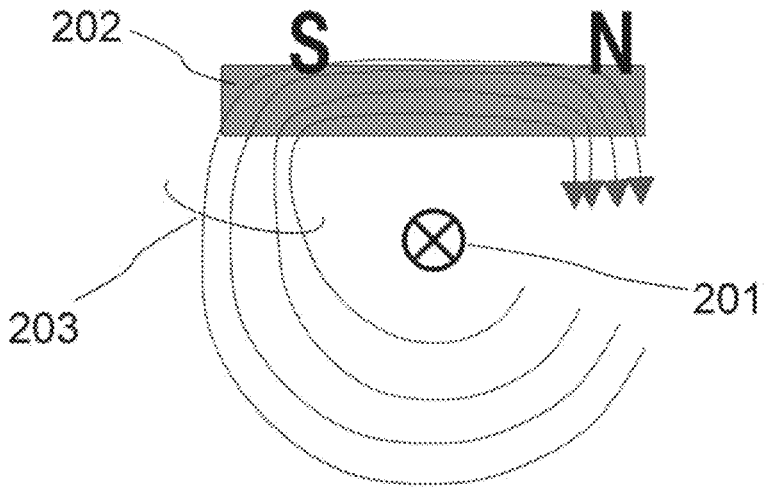
FIG. 10(*a*) is a diagram showing a magnetic field (magnetic fluxes) caused by energization in a case where a core having a cross sectional shape of a rectangle is arranged in the vicinity of a single conducting wire, and FIG. 10(*b*) is a partial, enlarged view thereof.
Figure 10B:
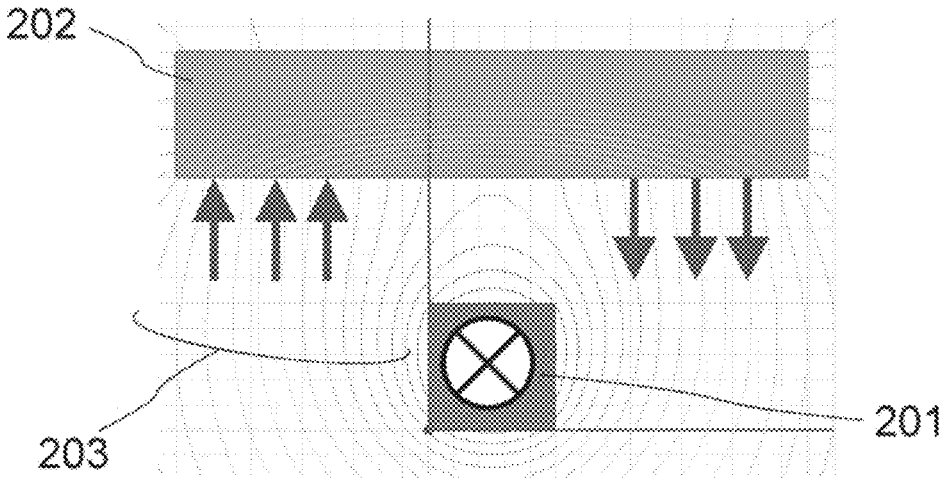
Figure 11:
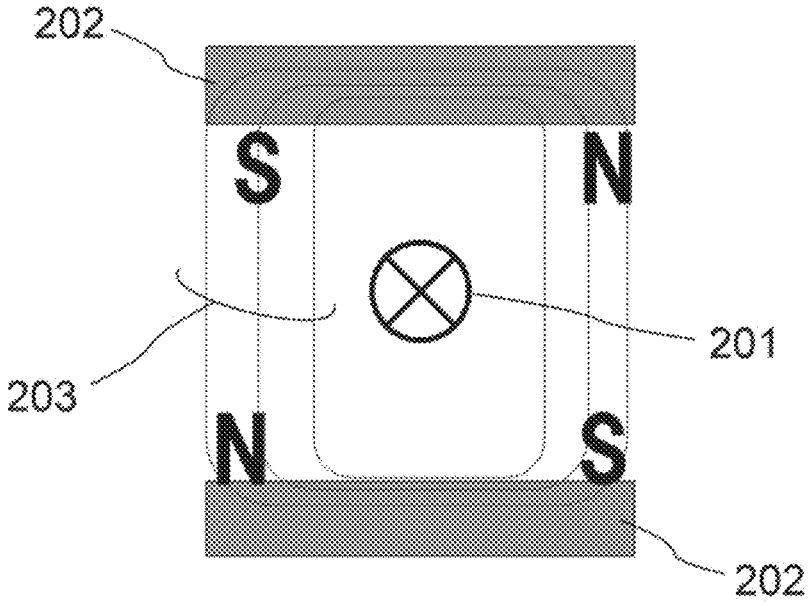
FIG. 11 is a diagram showing a magnetic field (magnetic fluxes) caused by energization in a case where a pair of cores each of which has a cross sectional shape of a rectangle is arranged in the vicinity of a single conducting wire.
Figure 12:
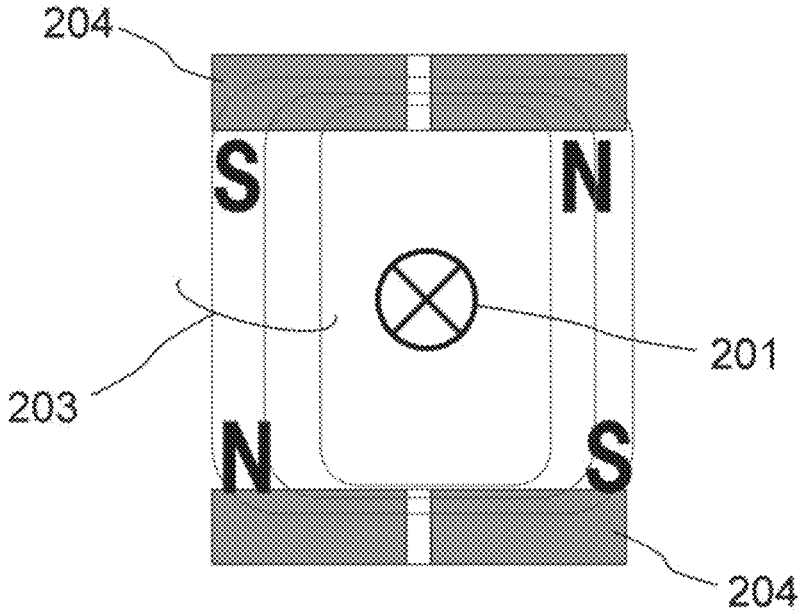
FIG. 12 is a diagram showing a magnetic field (magnetic fluxes) caused by energization in a case where a different pair of cores different from the cores of FIG. 11 in structure is arranged in the vicinity of a single conducting wire.

On the other hand, as shown in FIGS. 10(*a*) and 10(*b*), when a core 202 having a cross section of a rectangle is arranged in a magnetic field formed by a conducting wire 201, more magnetic fluxes 203 pass through the core 202. In other words, when the core 202 which is relatively long in the right-left direction of the figure is arranged in the magnetic field, a magnetic flux distribution is varied relatively largely. As a result, at both of right and left sides of the conducting wire 201, magnetic fields which are nearly vertical are formed. As shown in FIG. 11, when a pair of cores 202 is arranged above and below a conducting wire 201 to be opposed to each other with the conducting wire 201 interposed therebetween, magnetic fields formed at both of right and left sides of the conducting wire 201 can be get close to vertical magnetic fields. Moreover, as shown in FIG. 12, this is the same in a case where a pair of cores 204 each of which is formed by sandwiching a relatively short (thin) gap member between two relatively long core members is arranged to be opposed to each other with the conducting wire 201 interposed therebetween.

From the above, it can be understood that directions of a magnetic field in the vicinity of a conducting wire (coil) can be controlled by proper arranging a core(s) in the vicinity of the conducting wire (coil). According to studies made by the inventors, in a case where a pair of cores (upper and lower cores) is symmetrically arranged above and below a center of an electric current, magnetic fields which are nearly vertical can be formed in theory at both of right and left sides of a conducting wire (coil) by setting a demagnetization field coefficient of each of the upper and the lower cores to 0.3 or less in a magnetic field direction formed by the conducting wire (coil). Generally, this is a case where when a quadrilateral is assumed to have, as two edges thereof, a pair of cores (upper and lower cores) which are arranged to be opposed to each other with a conducting wire (coil) interposed therebetween, the quadrilateral is a rectangle having the upper and the lower cores as long sides thereof.

Figure 13:
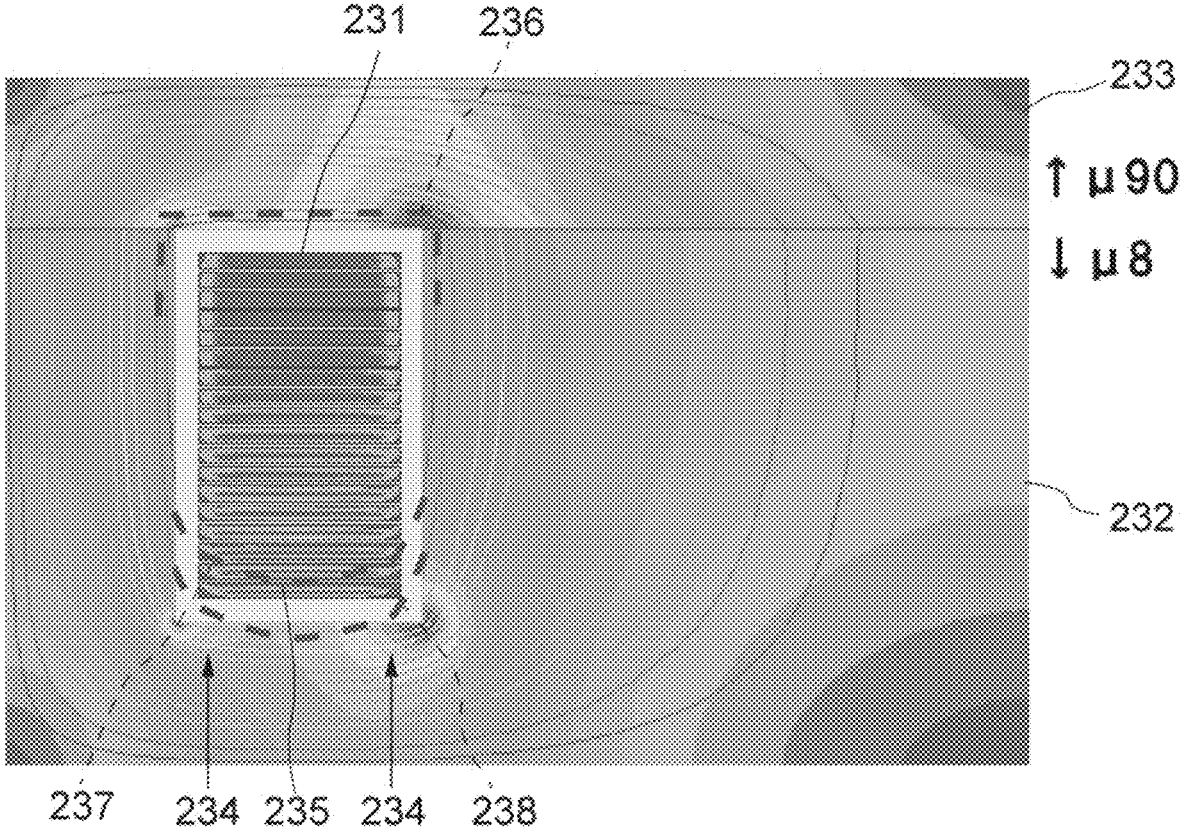
FIG. 13 is a diagram showing, in conjunction with magnetic fluxes, a magnetic flux distribution caused by energization in an edgewise coil embedded in a core. The core is formed with a lower core which surrounds a periphery of the coil except for one of end surfaces of the coil and has a relatively lower magnetic permeability and an upper core which is provided on the lower core to cover the one of the end surfaces and has a relatively higher magnetic permeability.

Next, using a coil (edgewise coil) in place of the single conducting wire, influence of the core arranged in the vicinity of the coil was studied. In FIG. 13, a coil 231 is embedded in a lower core 232 having a relatively lower magnetic permeability ($\mu_L$=8) to expose an one (upper side) of end surfaces thereof. Moreover, an upper core 233 having relatively high magnetic permeability ($\mu_H$=90) is arranged on the lower core 232 to cover the upper end surface of the coil 231. A winding axis of the coil 231 is positioned in the right side of the figure to extend in an up-down direction. In other words, FIG. 13 shows one of two cross sections of the coil 231 seen in a case where the coil is cut by a plane including the winding axis. The structure shown in FIG. 13 corresponds to a state (see FIG. 10) that the upper core 233 which is long in a right-left direction of the figure and has the relatively high magnetic permeability is arranged at a side of one (upper) of the end surfaces of the coil 231. In this structure, approximately vertical magnetic fields are formed at an inner side of an inner circumferential surface of the coil 231 and an outer side of an outer circumferential surface of the coil. As a result, in the coil 231, large alternating current copper loss regions 234 are biased to an inner circumferential surface side and an outer circumferential surface side (short sides of each turn). In other words, the magnetic flux leak to the coil 231 is reduced, and alternating current resistance loss is suppressed. However, in the vicinity of the other (lower) end surface of the edgewise coil 231, large alternating current copper loss regions 235 appear along long sides of each flat wire. It is presumed that this is because, as represented by broken lines 236-238 in FIG. 13, passing paths of magnetic fluxes are different from each other. It is deemed that this is because almost no magnetic flux leak exists in the upper end surface side of the edgewise coil 231, whereas the magnetic flux leak to the coil 231 exists in the vicinity of the lower end surface. However, it can be anticipated that such magnetic flux leak is suppressed by arranging another core, which has relatively high magnetic permeability like the upper core 233, under the edgewise coil 231.

As mentioned above, also in the case of the coil 231, similarly to in the case of the single conducting wire (see FIG. 10), approximately vertical magnetic fields (vertical magnetic fields) (in a direction along the winding axis) can be formed at both of right and left sides (an inner side of the inner circumferential surface and an outer side of the outer circumferential surface) thereof. Thus, alternating current resistance loss caused by the magnetic fluxes flowing into the coil from the core can be suppressed.

Next, study was made about distribution of magnetic fluxes and alternating current copper loss of a coil component in which a pair of cores having relatively high magnetic permeability is arranged on upper and lower sides of a coil. Specifically, simulations were made about five kinds of coil components (third to seventh models) varied in shape and winding system of winding wires of the coils and about two comparative coil components (first and second models). In the simulations, it was assumed that a core having a relatively high magnetic permeability was a dust core while a core having a relatively low magnetic permeability was cast core. The dust core is a thing in which soft magnetic alloy powder is compression-molded while the cast core is a thing in which slurry including soft magnetic alloy powder, binder (resin) and so on is hardened.

Figure 14A:
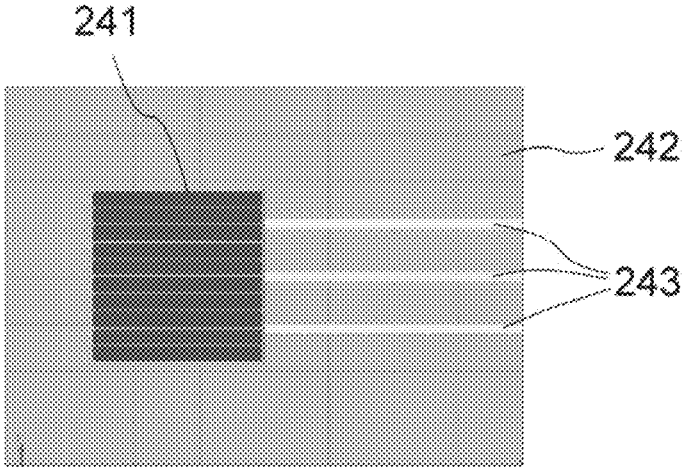
FIG. 14(*a*) is a partial, cross sectional view showing an outline structure of an approximately left half of a first coil component, FIG. 14(*b*) is a diagram showing a magnetic flux distribution caused by energization to a coil included in the coil component of FIG. 14(*a*), and FIG. 14(*c*) is a diagram showing an alternating current copper loss part distribution in the coil included in the coil component of FIG. 14(*a*).
Figure 14B:
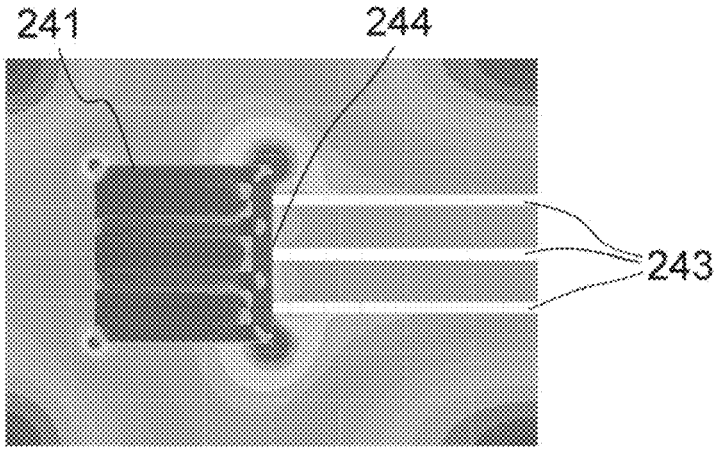
Figure 14C:
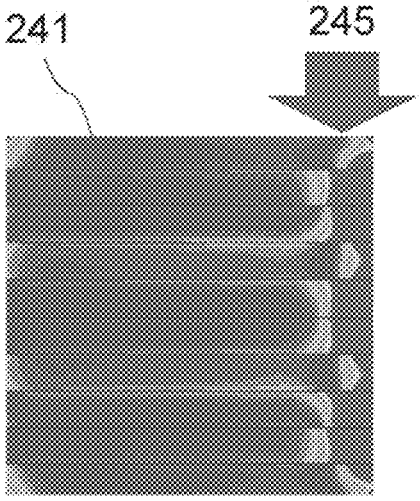

Referring to FIG. 14 (*a*), the first model has an edgewise coil 241, a dust core 242 arranged in a vicinity of the edgewise coil and three gaps 243 inserted into a magnetic path at an inner side of an inner periphery of the edgewise coil 241. A winding axis of the coil 241 is positioned in the right side of the figure to extend in an up-down direction. In other words, FIG. 14 (*a*) shows one of two cross sections, and the vicinity thereof, of the coil seen in a case where the coil component is cut by a plane including the winding axis. In this coil component, as shown in FIG. 14 (*b*), magnetic flux concentration is caused in a region 244 in the vicinity of a boundary between the coil 241 and the gaps 243 or at an inner periphery side of the coil 241. In other words, in the vicinity of the boundary between the edgewise coil 241 and the gaps 243, many magnetic fluxes are leaked from the dust core 242 to the edgewise coil 241. Accordingly, as shown in FIG. 14 (*c*), large alternating current copper loss regions 245 in the coil 241 are biased to the inner periphery side of the coil 241. The large alternating current copper loss regions 245 were biased to the inner periphery side in this structure, and alternating current copper loss according to the simulation was equal to 172 W as a large value.

Figure 15A:
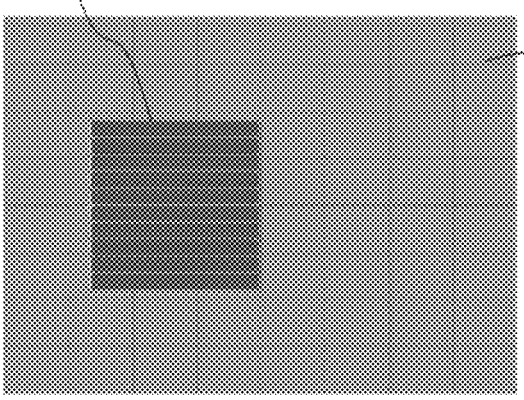
FIG. 15(*a*) is a partial, cross sectional view showing an outline structure of an approximately left half of a second coil component, FIG. 15(*b*) is a diagram showing a magnetic flux distribution caused by energization to a coil included in the coil component of FIG. 15(*a*), and FIG. 15(*c*) is a diagram showing an alternating current copper loss part distribution in the coil included in the coil component of FIG. 15(*a*).
Figure 15B:
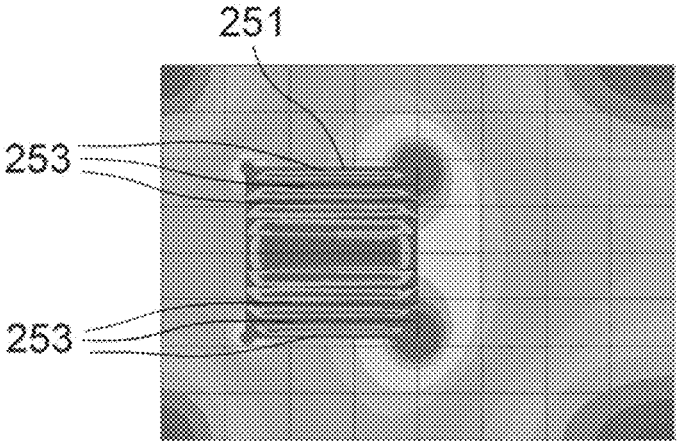
Figure 15C:
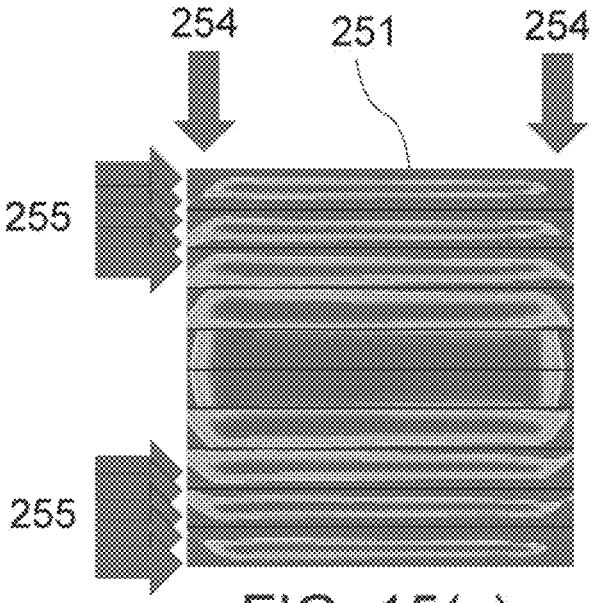

Referring to FIG. 15(*a*), the second model has an edgewise coil 251 and a cast core 252 arranged in the vicinity of the edgewise coil. In this coil component, as seen in FIG. 15(*b*), magnetic flux concentration is seen in regions 253 along long sides of each flat wire in both upper and lower sides of the coil 251. As a result, according this structure, as shown in FIG. 15(*c*), although large alternating current copper loss regions 254 are biased to an inner periphery side and an outer periphery side at middle portions in up-down direction, large alternating current copper loss regions 255 extend along the long sides of the cross section of each flat wire in upper and lower side portions of the coil. Alternating current copper loss according to the simulation was equal to 230 W.

Figure 16A:
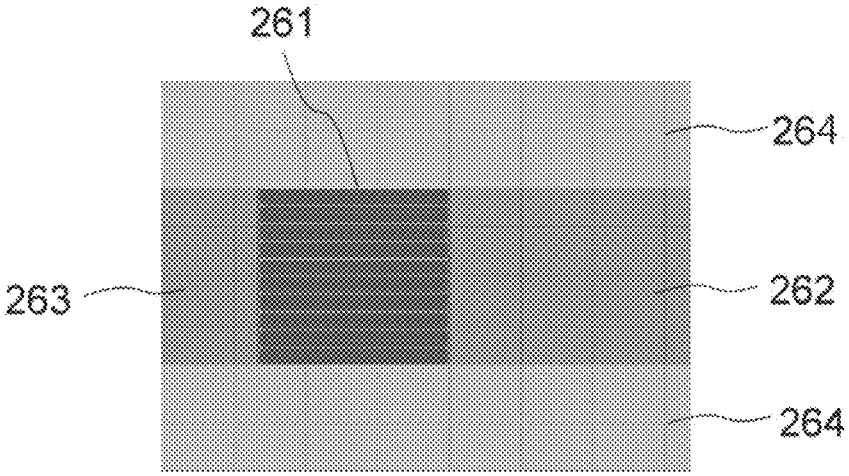
FIG. 16(*a*) is a partial, cross sectional view showing an outline structure of an approximately left half of a third coil component, FIG. 16(*b*) is a diagram showing a magnetic flux distribution caused by energization to a coil included in the coil component of FIG. 16(*a*), and FIG. 16(*c*) is a diagram showing an alternating current copper loss part distribution in the coil included in the coil component of FIG. 16(*a*).
Figure 16B:
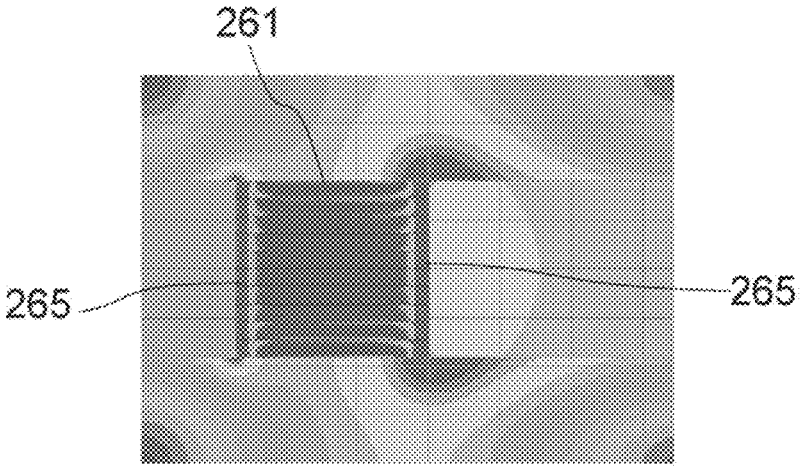
Figure 16C:
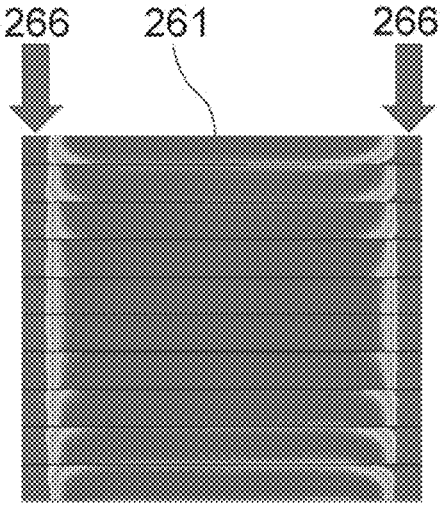

Referring to FIG. 16(*a*), the third model has an edgewise coil 261, cast cores 262 and 263 arranged at an inner side of an inner periphery and an outer side of an outer periphery of the edgewise coil, respectively, and a pair of dust cores 264 which cover end surfaces of the edgewise coil 261 and couple the two cast cores 262 and 263 to each other. In this coil component, as seen in FIG. 16(*b*), magnetic flux concentration is caused in regions 265 along short sides of the flat wire. As shown in FIG. 16(*c*), large alternating current copper loss regions 266 were biased to an inner periphery side and an outer periphery side of the coil 261 in this structure, and alternating current copper loss according to the simulation was equal to 48.2 W as the smallest value.

Figure 17A:
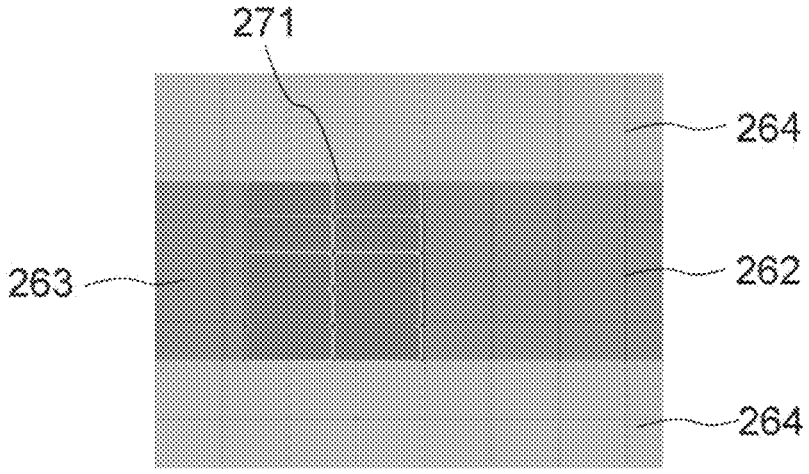
FIG. 17(*a*) is a partial, cross sectional view showing an outline structure of an approximately left half of a fourth coil component, FIG. 17(*b*) is a diagram showing a magnetic flux distribution caused by energization to a coil included in the coil component of FIG. 17(*a*), and FIG. 17(*c*) is a diagram showing an alternating current copper loss part distribution in the coil included in the coil component of FIG. 17(*a*).
Figure 17B:
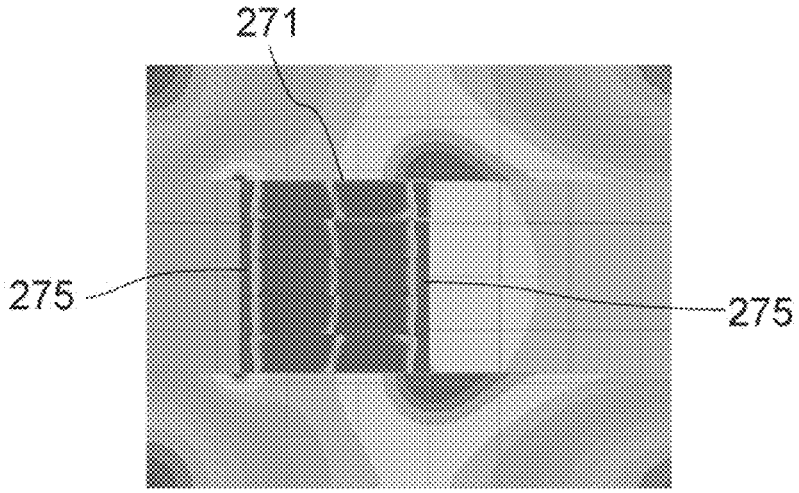
Figure 17C:
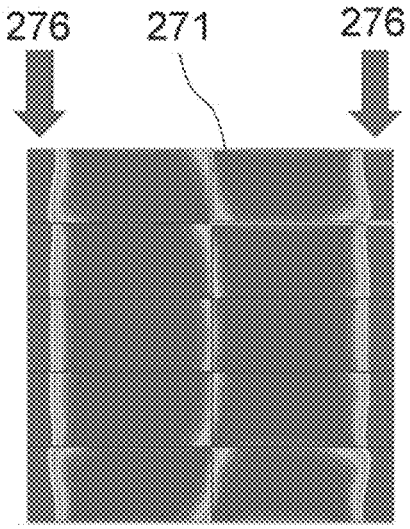

Referring to FIG. 17 (*a*), the fourth model has a structure similar to that of FIG. 16 (*a*). A different point between this coil component and the coil component of FIG. 16 (*a*) is a point that winding rows of an edgewise coil 271 are two in number. As understood from comparison of FIG. 16(*b*) with FIG. 17 (*b*), even when the number of the winding rows is increased to two, magnetic flux dispersion thereof is not largely different from a case where the number of winding rows is one. That is, magnetic flux concentration is caused in regions 275 of an inner periphery side and an outer periphery side of the coil 271. As shown in FIG. 17(*c*), large alternating current copper loss regions 276 were biased to the inner periphery side and the outer periphery side of the coil 271, and alternating current copper loss according to the simulation was equal to 49.5 W as a smaller value.

Figure 18A:
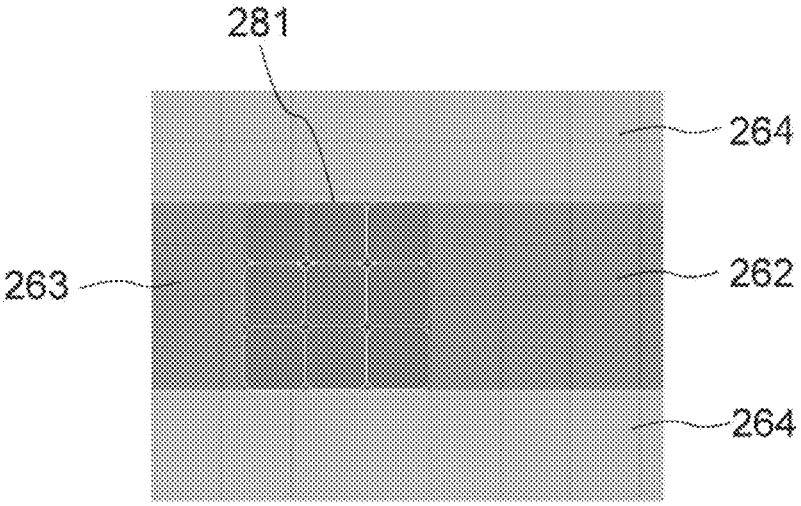
FIG. 18(*a*) is a partial, cross sectional view showing an outline structure of an approximately left half of a fifth coil component, FIG. 18(*b*) is a diagram showing a magnetic flux distribution caused by energization to a coil included in the coil component of FIG. 18(*a*), and FIG. 18(*c*) is a diagram showing an alternating current copper loss part distribution in the coil included in the coil component of FIG. 18(*a*).
Figure 18B:
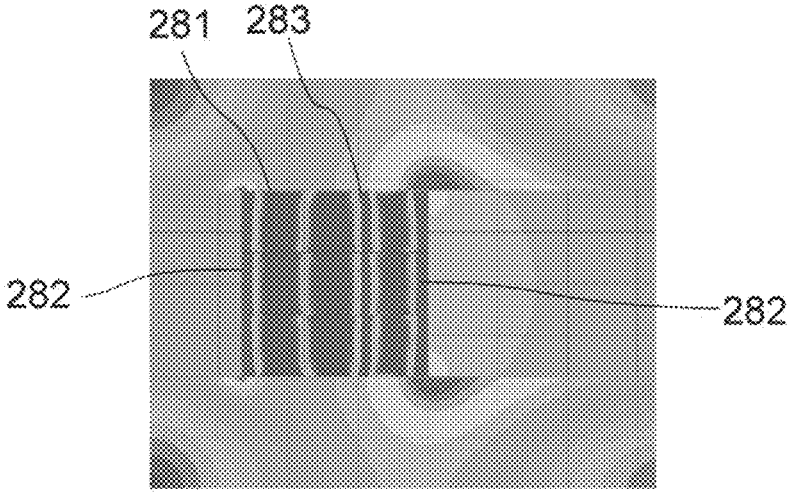
Figure 18C:
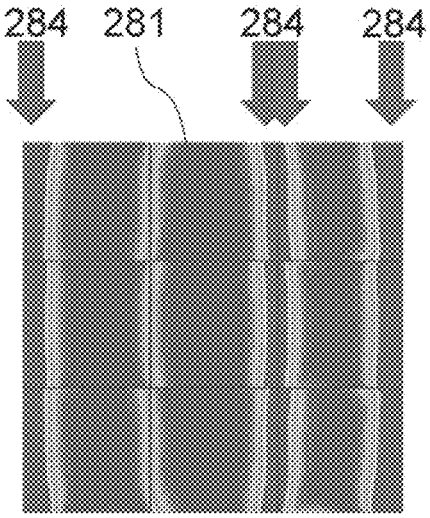

Referring to FIG. 18(*a*), the fifth model has a coil 281 into which a square wire is wound in 3 layers by 3 rows, cast cores 262 and 263 arranged at an inner side of an inner periphery and at an outer side of an outer periphery of the coil, respectively, and a pair of dust cores 264 which cover end surfaces of the coil 281 and couple the two cast cores 262 and 263 to each other. In this coil component, as seen in FIG. 18(*b*), magnetic flux concentration is caused in regions 282 of the inner periphery side and the outer periphery side of the coil 281 and caused in a region 283 along a boundary between winding rows in the coil 281. In this structure, as shown in FIG. 18(*c*), large alternating current copper loss regions 284 exist at not only the inner periphery side and the outer periphery side of the coil 281 but also inside the coil. Then, alternating current copper loss according to the simulation was equal to 71.8 W.

Figure 19A:
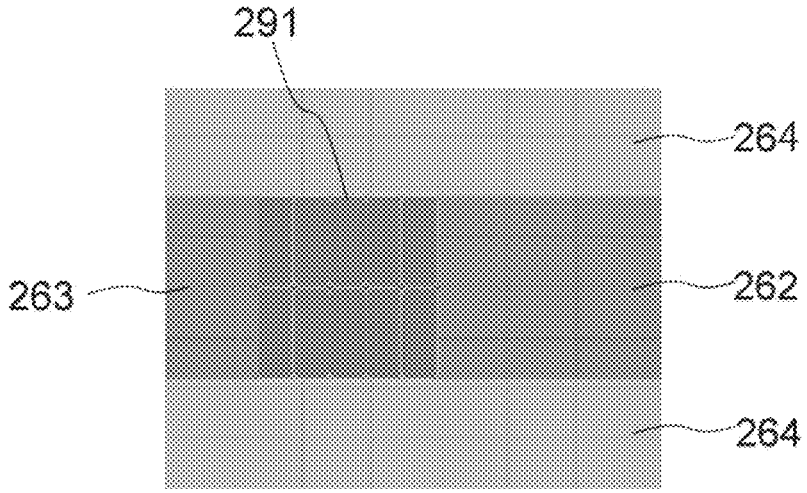
FIG. 19(*a*) is a partial, cross sectional view showing an outline structure of an approximately left half of a sixth coil component, FIG. 19(*b*) is a diagram showing a magnetic flux distribution caused by energization to a coil included in the coil component of FIG. 19(*a*), and FIG. 19(*c*) is a diagram showing an alternating current copper loss part distribution in the coil included in the coil component of FIG. 19(*a*).
Figure 19B:
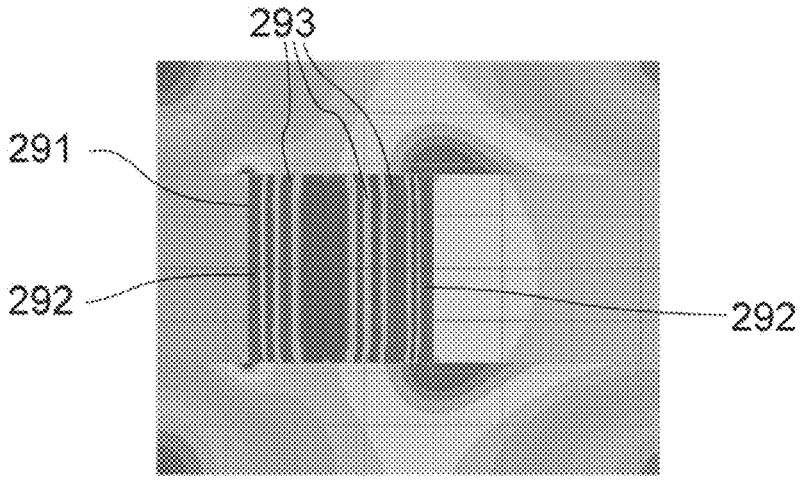
Figure 19C:
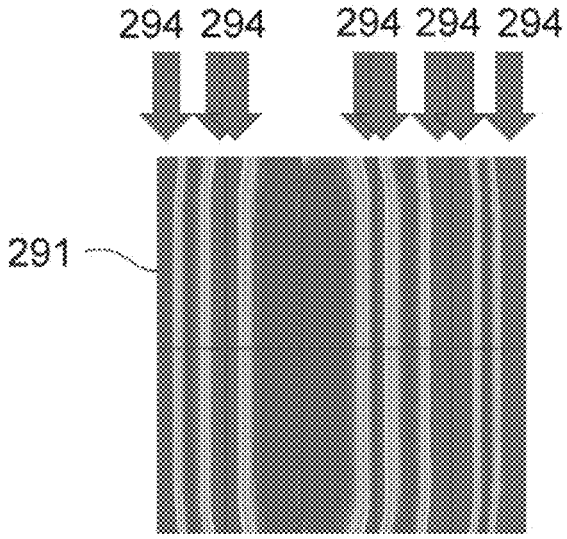

Referring to FIG. 19(*a*), the sixth model has a coil 291 into which a flat wire is wound in 2 layers by 5 rows, cast cores 262 and 263 arranged at an inner side of an inner periphery and an outer side of an outer periphery of the coil, respectively, and a pair of dust cores 264 which cover end surfaces of the coil 291 and couple the two cast cores 262 and 263 to each other. Also in this coil component, as seen in FIG. 19(*b*), magnetic flux concentration is caused in regions 292 of an inner periphery side and an outer periphery side of the coil 291 and further caused in regions 293 along boundaries between winding rows in the coil 291. As understood from comparison with FIG. 18(*b*), in accordance with increase of the number of winding rows, the number of the regions 293 where the magnetic flux concentration is generated is increased. Similarly, the number of the large alternating current copper loss regions 294 is increased as shown in FIG. 19(*c*). Alternating current copper loss according to the simulation was equal to 90.9 W.

Figure 20A:
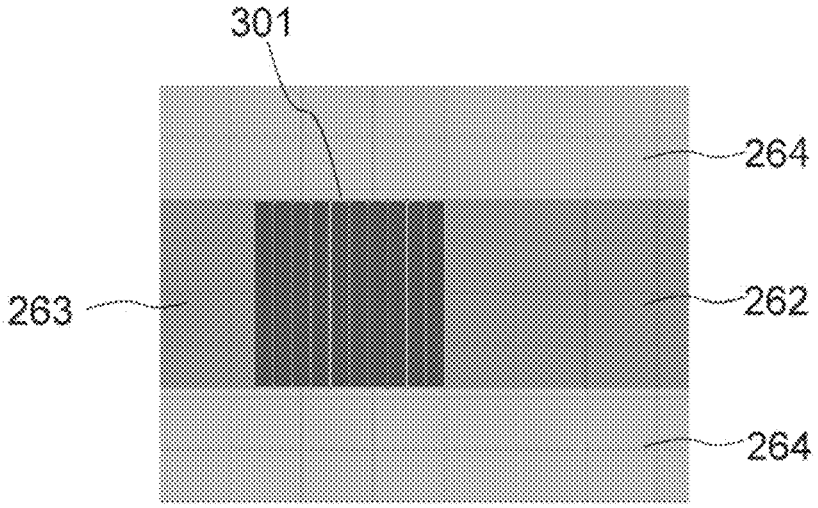
FIG. 20(*a*) is a partial, cross sectional view showing an outline structure of an approximately left half of a seventh coil component, FIG. 20(*b*) is a diagram showing a magnetic flux distribution caused by energization to a coil included in the coil component of FIG. 20(*a*), and FIG. 20(*c*) is a diagram showing an alternating current copper loss part distribution in the coil included in the coil component of FIG. 20(*a*).
Figure 20B:
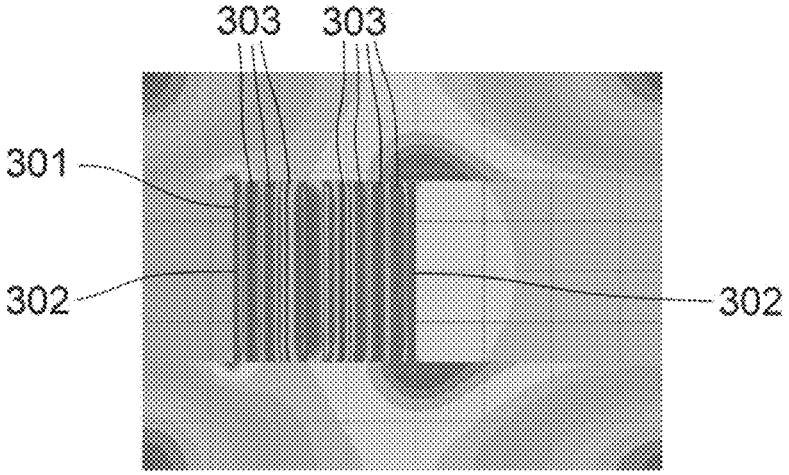
Figure 20C:
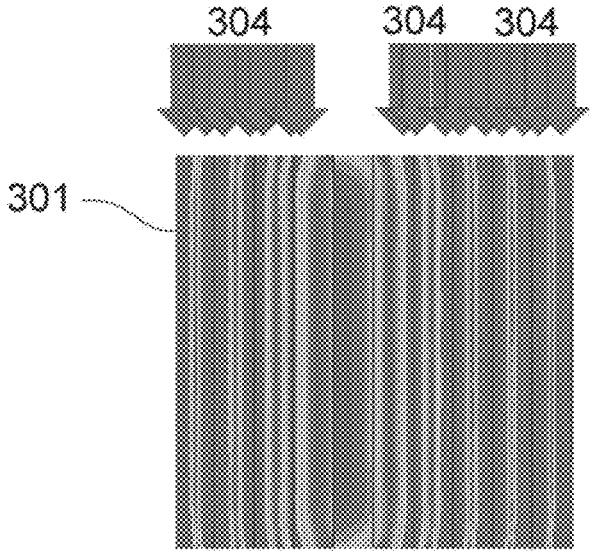
Figure 21:
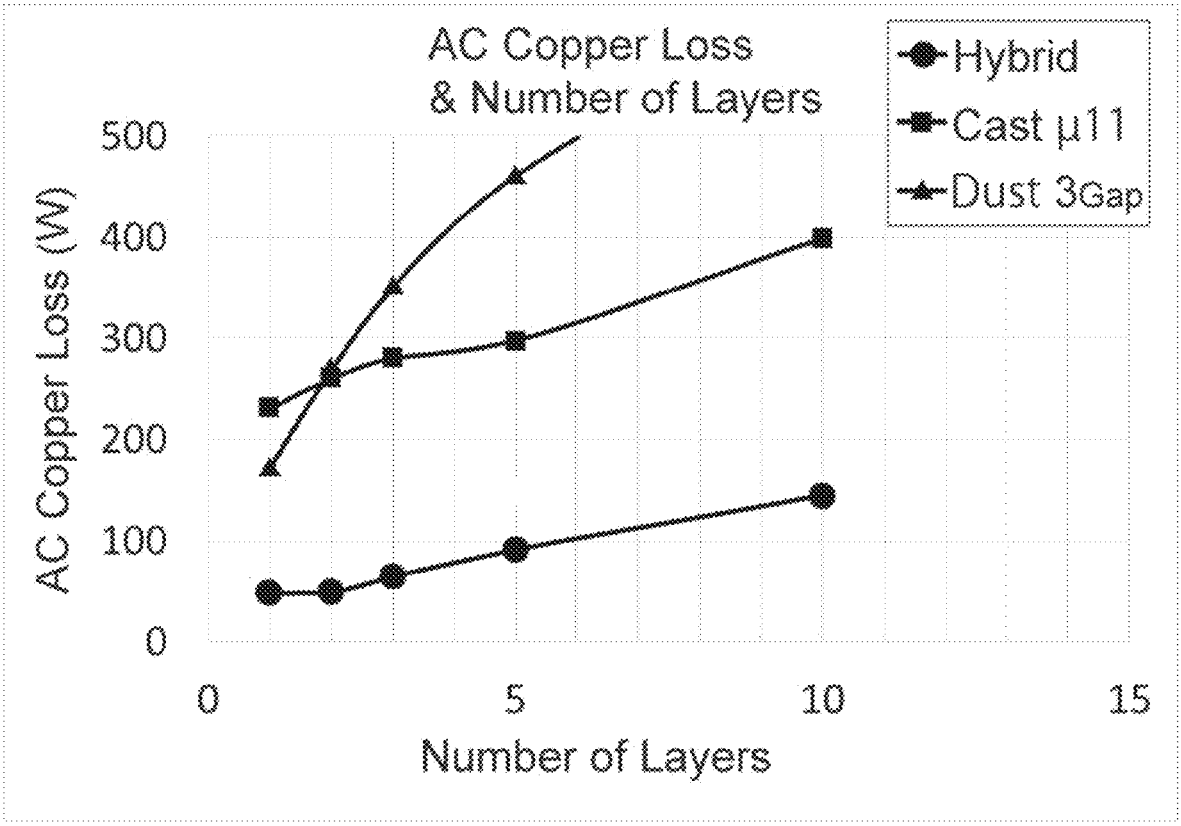
FIG. 21 is a graph showing a relationship between the numbers of winding rows of coils and alternating current copper loss. It shows a case of using a dust core as a core, a case of using a cast core and a case of a combination (hybrid) of a dust core and a cast core.

Referring to FIG. 20(*a*), the seventh model has a flatwise coil 301, cast cores 262 and 263 arranged at an inner side of an inner periphery and an outer side of an outer periphery of the flatwise coil, respectively, and a pair of dust cores 264 which cover end surfaces of the flatwise coil 301 and couple the two cast cores 262 and 263 to each other. Also in this coil component, as seen in FIG. 20(*b*), magnetic flux concentration is caused in regions 302 of an inner periphery side and an outer periphery side of the coil 301 and caused in regions 303 along boundaries between winding rows in the coil 301. The number of the regions 303 where the magnetic flux concentration is caused is more increased than a case of FIG. 19(*b*). Moreover, as shown in FIG. 20(*c*), large alternating current copper loss regions 304 are increased in comparison with a case of FIG. 19(*c*). Furthermore, alternating current copper loss according to the simulation was increases to 144.1 W.

As understood from FIGS. 14 to 20, the third to the seventh models (FIGS. 16 to 20) in which the pair of dust cores is arranged on the upper and lower sides of the coil can reduce alternating current copper loss in comparison with the first model (FIG. 14) in which the entire core is a dust core and combined with gaps or in comparison with the second model (FIG. 15) in which the whole core is cast core. It is presumed that this is because the magnetic flux leak to the coil are reduced as a result that the magnetic fields which are nearly vertical are formed at the inner side of the inner periphery and the outer side of the outer periphery of the coil as mentioned above.

Moreover, as understood from FIGS. 16 to 20 and FIG. 21, as the number of the winding rows is increased, the alternating current copper loss is increased. This is considered to be due to the following reasons.

Figure 22:
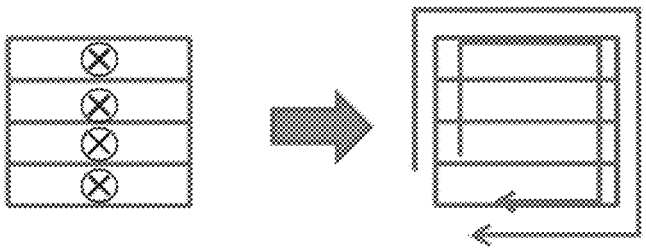
In FIG. 22, a left diagram is a diagram showing a structure of a coil and a direction of a current flowing in the coil, and a right diagram is a diagram showing a magnetic field caused by energization to the coil.
Figure 23:
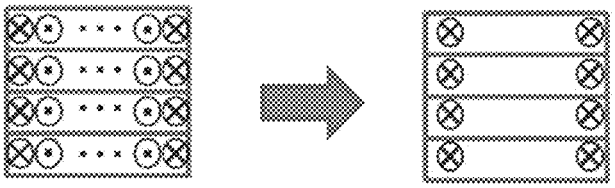
In FIG. 23, a left diagram is a diagram showing directions of eddy currents possible to be caused inside a coil in theory, and a right diagram is a diagram showing directions of currents derived from eddy currents caused actually inside the coil.

When a current having a backside direction as shown in the left figure of FIG. 22 flows in a coil (edgewise coil, 1 row by 4 layers) of a coil component having a structure similar to that of FIG. 16, a clockwise magnetic field as represented by arrows in the right figure of FIG. 22 is caused. To cancel this magnetic field, a plurality of eddy currents is caused in the winding wire (flat wire) of the coil as shown in the left figure of FIG. 23. These eddy currents, however, cancel out each other in each flat wire. As a result, as shown in the right figure of FIG. 23, it seems that the eddy currents positioned at longitudinal direction end portions in a cross section of the flat wire merely remain.

Figure 24:
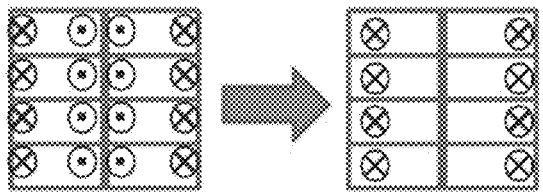
In FIG. 24, a left diagram is a diagram showing directions of currents derived from eddy currents caused inside a coil, and a right diagram is a diagram showing that currents in a middle portion are negligible because they are small.

Because the flat wire is coated by an insulating film, cancellation of the eddy currents is caused by unit of the flat wire (in each turn). In other words, the cancellation of the eddy currents is not caused between the flat wires adjacent to each other. Accordingly, as the number of the winding rows is increased, residual eddy currents are increased. For example, in a case where the number of the winding rows is equal to two, the eddy currents remain at not only both side portions (inner periphery side and outer periphery side) of the coil but also a middle portion as shown in the left figure of FIG. 24. However, the amount of the eddy current is increased according to the strength of the magnetic field, and the eddy current caused in a middle part of the coil is smaller than that caused in an outer part of the coil. Therefore, in the case where the number of the winding rows is equal two, it is considered that the eddy currents caused in both side parts remain as shown in the right figure of FIG. 24.

Figure 25:
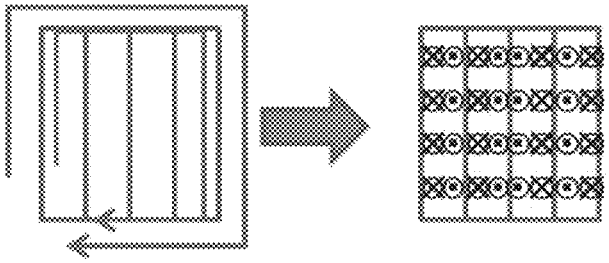
In FIG. 25, a left diagram is a diagram showing a structure of a coil and a magnetic field caused by energization to the coil, and a right diagram is a diagram showing directions of eddy currents caused inside the coil.

However, when the number of the winding rows is increased, by the proximity effect described in JPA 2013-26589, the eddy currents remain in each row. For instance, the number of the winding rows is equal to four as shown in the left figure of FIG. 25, the eddy currents remain in end parts of each row as the right figure of FIG. 25. As mentioned above, the eddy current is larger at the outer part of the coil, and the eddy currents cannot be ignored except for the middle part. In addition, except for the middle part, directions of the eddy currents caused at the boundary between adjacent winding rows are opposite to each other. Accordingly, it is considered that a state that the eddy currents can be easily induced is formed, increasing alternating current copper loss.

Thus, as the number of the winding rows is increased, the alternating current copper loss is increased. Nevertheless, as understood from FIG. 21, the third to the sevens models ("Hybrid", FIGS. 16 to 20) in which the pair of dust cores is arranged on the upper and lower sides of the coil can significantly reduce the alternating current copper loss in comparison with the case where the whole core consists of the dust core and is combined with the gaps ("Dust 3 Gap", the first model (FIG. 14) and a coil component having a structure similar thereto) or the case where the entire core consists of the cast core ("Cast μ11 (cast core with magnetic permeability μ=11 at zero magnetic field)", the second model (FIG. 15) and a coil component having a structure similar thereto). This is true of a case where the number of the winding rows equal to 10.

In the third to the seventh models, the dust cores were assumed as the cores which are arranged on the upper and lower sides of the coil. Even when, regarding a portion covering the end surface of the coil, at least a part of the core was replaced by a cast core or a nonmagnetic gap, significant increase of the alternating current copper loss could not be seen. Accordingly, reduction of the alternating current copper loss is expected by arranging cores with relatively high magnetic permeability at least in regions corresponding to corners of the coil. In other words, in a cross section obtained by cutting a coil component by a plane including a winding axis of a coil and a magnetic path making a circuit in the core, when the vicinity of each of coil sections is divided into eight regions by four straight lines extending along an inner circumferential surface, an outer circumferential surface and end surfaces, cores having relatively high magnetic permeability may be disposed in four of the regions positioned at corners. In this case, at the regions of an inner side of the inner circumferential surface and an outer side of the outer circumferential surface, cores having relatively low magnetic permeability are disposed. When the relatively high magnetic permeability $\mu_H$ is equal to 100, for example, an excellent result can be obtained by setting the relatively low magnetic permeability $\mu_L$ to about tenth part, e.g. 10, of the relatively high magnetic permeability.

In the aforementioned studies made by the present inventors, attention was paid to the magnetic field (vertical magnetic field) perpendicular to the winding axis of the coil. However, similar results can be expected also in a case where attention is paid directed to a magnetic field in a direction (radial direction) perpendicular to the winding axis of the coil. In other words, magnetic fields in outer sides of end surfaces of a coil can be controlled by arranging cores having relatively high magnetic permeability at an inner side of an inner periphery and an outer side of an outer periphery, and thereby expected to reduce alternating current copper loss in the coil. In the aforementioned structure in which the cores having the relatively high magnetic permeability are disposed in the four regions positioned at the corners in the cross section of the coil component, not only the vertical magnetic field but also the magnetic field in the radial direction can be controlled. In a case of paying attention to the magnetic field in the radial direction, it is desirable to use a coil different from that in the case of paying attention to the vertical magnetic field. In other words, in this case, it is desirable to use, as the coil, a coil having a smaller number of boundaries between conducting wires exposed on the end surfaces (e.g. a flatwise coil).

Figure 26:
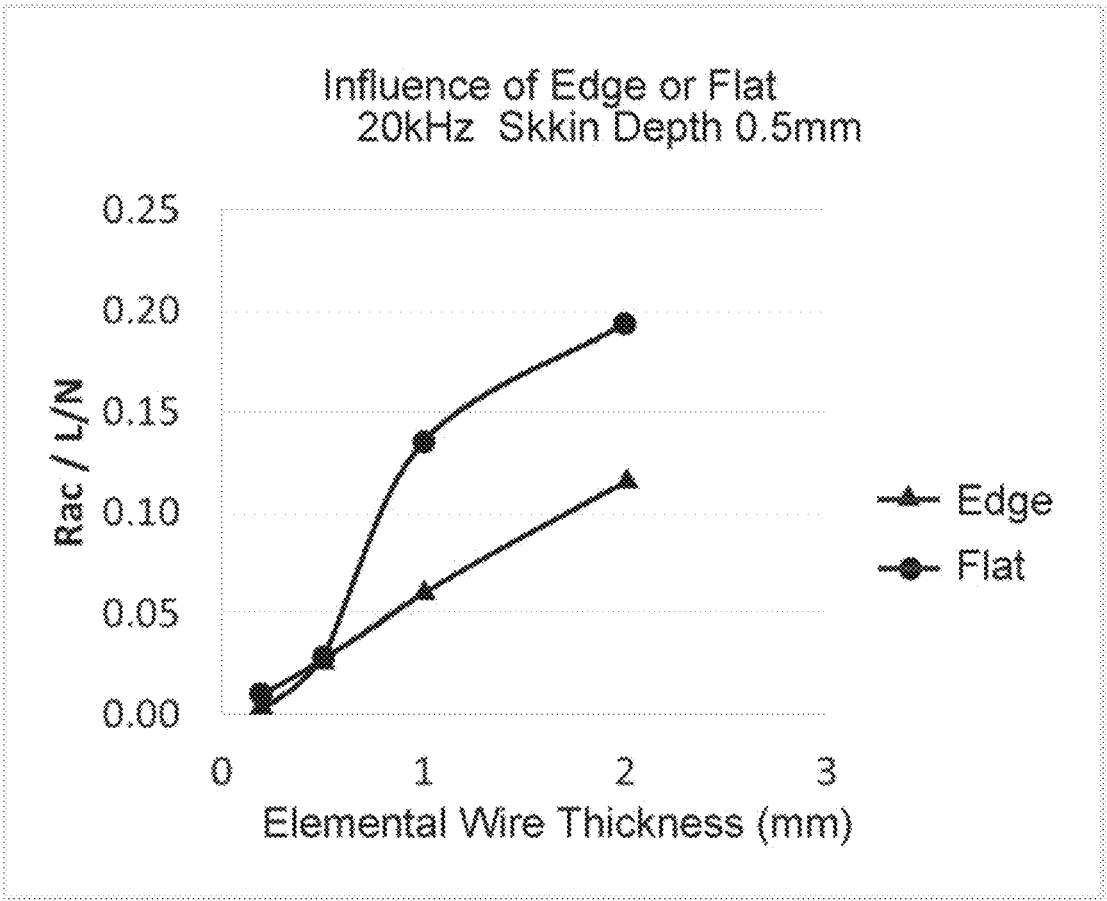
FIG. 26 is a graph showing relationships between thicknesses of winding wires and loss coefficients in each of an edgewise coil and a flatwise coil.

Next, studies was carried out about influence of thickness of winding wires (elemental wires). Referring to FIG. 26, it can be understood that alternating current copper loss of a coil is increased as a thickness of a winding wire (elemental wire) is increased. When the thickness of the winding wire (conductor) is same as the skin depth or less, there is no significant difference between the edgewise coil ("Edge") and the flatwise coil ("Flat") in loss coefficient (Rac/L/N). However, when the thickness of the winding wire becomes thicker than the skin depth, the loss coefficient of the flatwise coil is abruptly increased. In contrast to this, the loss coefficient of the edgewise coil is linearly increased in accordance with increase of the thickness of the elemental wire. In this manner, abrupt increase of alternating current copper loss as that caused in the case of the flatwise coil is not caused, even when the thickness of the winding wire is increased. Accordingly, use of the edgewise coil is advantageous in a case where the thickness of the winding wire is larger.

As a result of the aforementioned studies, the present inventors came to realize the present invention. Although the present invention aims to reduce alternating current copper loss by suppressing magnetic fluxes flowing from a core into a coil, there is a possibility that it is not all.

First Embodiment

Figure 27:
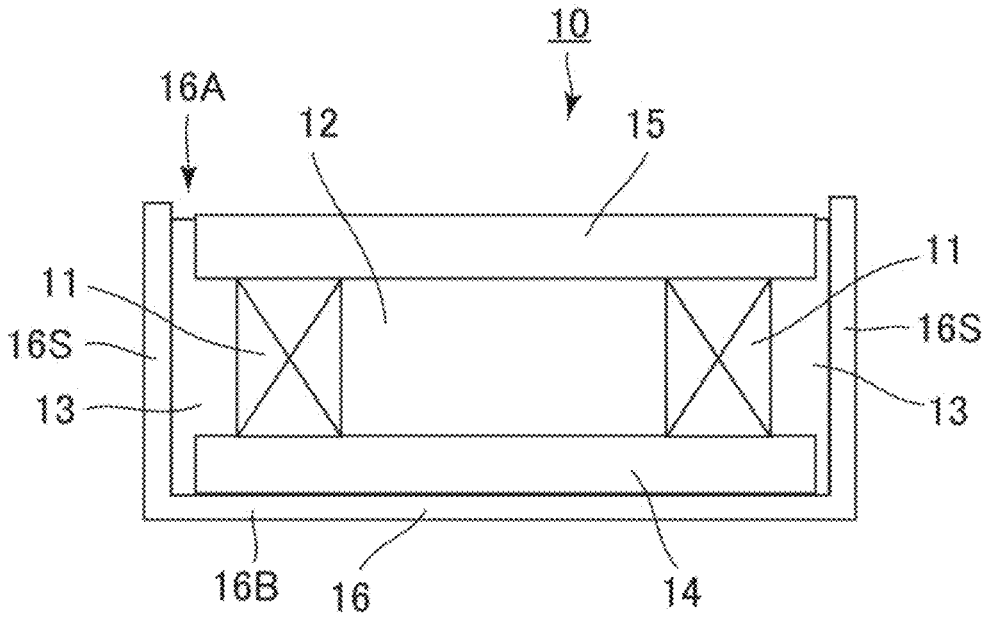
FIG. 27 is a cross sectional view showing a structure of a coil component according to a first embodiment of the present invention.

Next, the description will be made about a first embodiment of the present invention in detail. As shown in FIG. 27, a coil component 10 of the first embodiment of the present invention is provided with a coil 11, an inner peripheral side core 12 disposed at an inner side of an inner periphery of the coil 11, an outer peripheral side core 13 disposed at an outer side of an outer periphery of the coil 11, a pair of end surface side cores 14 and 15 and a case 16 accommodating those. In FIG. 27, a winding axis of the coil 11 is positioned at a middle in a right-left direction of the figure to extend in an up-down direction of the figure. FIG. 27 does not show a use state of the coil component 10. In the use state, the winding axis of the coil 11 may be directed to any direction. This holds true for other embodiments described below.

The coil 11 is an edgewise coil into which a winding wire (conducting wire) is wound to overlap itself along the winding axes direction. In other words, the coil 11 has a cross sectional shape of an approximately rectangular shape and is formed by winding the conducting wire (flat wire) (not shown) whose periphery is coated by insulator (not shown) in a helical fashion. In detail, the coil 11 of the present embodiment is formed by winding the conducting wire in the helical fashion and a quadrangle shape to have a linear winding axis. Accordingly, the coil 11 of the present embodiment has an approximately quadrangular shape in a plane perpendicular to the winding axis. The coil 11 may further have an insulator cover the periphery of a winding body formed by winding the conducting wire. At any rate, the coil 11 has an inner circumferential surface, an outer circumferential surface and a pair of end surfaces continuous with those.

The inner peripheral side core 12 is disposed at the inner side of the inner circumferential surface of the coil 11 to be contact with the inner circumferential surface of the coil 11. Moreover, the outer peripheral side core 13 is disposed at the outer side of the outer circumferential surface of the coil 11 to be contact with the outer circumferential surface of the coil 11. The inner peripheral side core 12 and the outer peripheral side core 13 are formed at the same time using the same material. Specifically, the inner peripheral side core 12 and the outer peripheral side core 13 are formed by heat hardening slurry 20 (see FIG. 31) formed with soft magnetic metal powder, a thermosetting binder component, a solvent and so on. The inner peripheral side core 12 and the outer peripheral side core 13 have relatively low magnetic permeability (low μ) at a zero magnetic field. In detail, the magnetic permeability of the inner peripheral side core 12 and the outer peripheral side core 13 is equal to 3 to 15, preferably 7 to 12, especially preferably about 10. It should be noted that the core formed by hardening the slurry 20 may be referred to as a cast core in the following description.

The pair of the end surface side cores 14 and 15 covers a pair of the end surfaces of the coil 11 and couples the inner peripheral side core 12 to the outer peripheral side core 13 mechanically and magnetically. As a result, the inner peripheral side core 12, the outer peripheral side core 13 and end surface side cores 14 and 15 form a closed magnetic path. Each of the end surface side cores 14 and 15 of the pair is a dust core which is formed by compression molding soft magnetic metal powder, such as iron alloy powder with high saturation magnetic flux density, by using high pressure. Each of these end surface side cores 14 and 15 has a substantially uniform thickness and a board shape with a pair of main surfaces. The end surface side cores 14 and 15 have higher magnetic permeability (high μ) at a zero magnetic field in comparison with the inner peripheral side core 12 and the outer peripheral side core 13. Specifically, the magnetic permeability of the end surface side cores 14 and 15 is greater than or equal to 50, preferably 50 to 150, and especially preferably about 90.

In detail, in the plane perpendicular to the winding axis of the coil 11, the end surface side cores 14 and 15 have a size larger than the outer circumferential surface of the coil 11 and protrude outward of the outer circumferential surface of the coil 11. In other words, the end surface side cores 14 and 15 of the present embodiment have a rounded quadrangular shape, and edge portions of them protrude over the outer circumferential surface of the coil 11 like a flange. Consequently, if the end surface side cores 14 and 15 and the coil 11 are seen along the direction of the winding axis of the coil 11, the coil 11 is hidden by the end surface side cores 14 and 15 and cannot be seen. However, the present invention is not limited to this structure. That is, the end surface side cores 14 and 15 may not protrude outward from all around of the outer periphery of the coils 11. For example, in a case where the coil 11 has an approximately quadrangular shape in a plane view (seen from the upper side of FIG. 27), the end surface side cores 14 and 15 may protrude from one of two sets of edges, which are opposite to each other, of the coil 11 outward of the outer periphery (in right-left direction of FIG. 27), but not protrude from the edges of the other set outward of the outer periphery (in front-rear direction of FIG. 27). Specifically, it may have a shape called as an EE (or EI) core. In this case, end surface portions corresponding to the edges of the other set of the coil may be covered with the end surface side cores 14 and 15 partly or wholly, or may be covered with the outer peripheral side core 13 partly or wholly, or may be exposed outside partly or wholly. Moreover, the outer peripheral side core (second core member) 13 may not be disposed at the outer side of the outer circumferential surface of the coil that corresponds to the edges of the other set, and the outer circumferential surface of the coil may directly be contact with a case.

Figure 28:
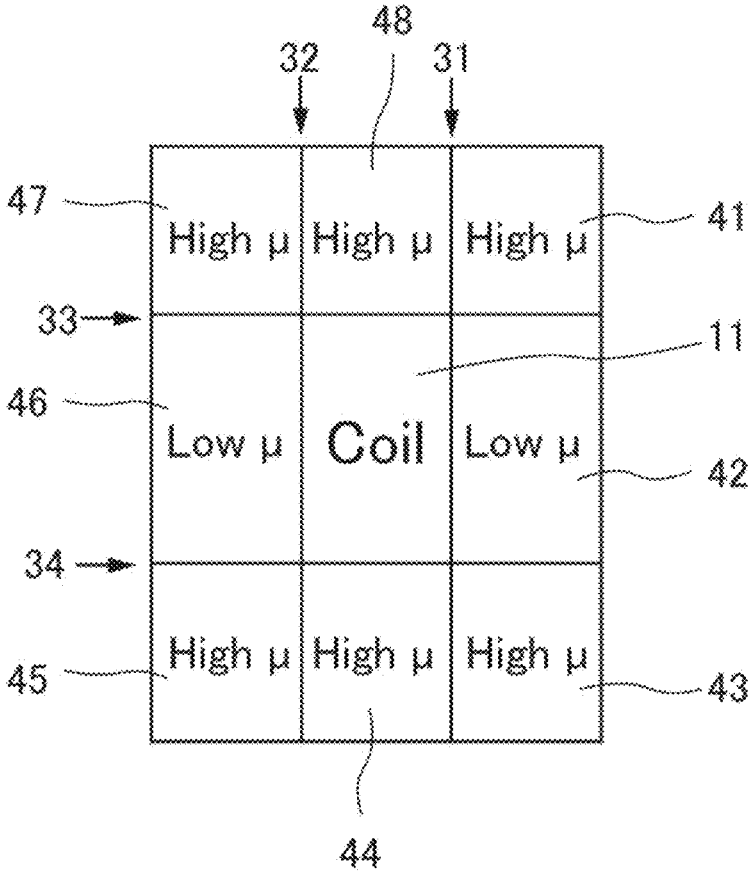
FIG. 28 is a diagram for further describing the structure of the coil component of FIG. 27.

From a different point of view, the structure of the core 12, 13, 14 and 15 can be said as follows. That is, as shown in FIG. 28, in a cross section obtained by cutting the coil component by a plane including the winding axis of the coil 11 and a magnetic path making a circuit in the cores (12, 13, 14, 15), when the vicinity of the coil 11 (the vicinity of each of two coil sections seen in the cross section of the coil component) is divided into eight regions 41 to 48 by four straight lines 31 to 34 extending along the inner circumferential surface, the outer circumferential surface and the end surfaces, dust cores (first core members, high μ) are respectively disposed in four regions 41, 43, 45 and 47 positioned at corners thereof, cast cores (second core members, low μ) are disposed in the region 42 positioned at the inner side of the inner circumferential surface and the region 46 positioned at the outer side of the outer circumferential surface, respectively, and dust cores (third core members, high μ) are disposed in the regions 44 and 48 positioned at the outer sides of the end surfaces, respectively.

Referring to FIG. 27 again, the case 16 is made of a metal such as aluminum. The depicted case 16 has an opening 16A and a bottom portion 16B in an extending direction of the winding axis of the coil 11 and has a side surface portion 16S connecting the opening 16A to the bottom portion 16B. More specifically, the bottom portion 16B has a rounded quadrangular shape while the side surface portion 16S has an approximately square tubular shape. The inner peripheral side core 12, the outer peripheral side core 13, the end surface side cores 14 and 15 and the coil 11 are arranged in the case 16. Inside the case 16, the inner peripheral side core 12 and the outer peripheral side core 13 are in absolute contact with the coil 11 and the end surface side cores 14 and 15. The end surface side core 15, which is closer to the opening 16A than the bottom portion 16B, is positioned apart from the side surface portion 16S. That is, in the plane perpendicular to the winding axis of the coil 11, the end surface side core 15 is smaller than the side surface portion 16S. Between the end surface side core 15 and the side surface portion 16S, a part of the outer peripheral side core 13 enters in part. Similarly, the end surface side core 14, which is closer to the bottom portion 16B than the opening 16A, is positioned apart from the side surface portion 16S. That is, in the plane perpendicular to the winding axis of the coil 11, the end surface side core 14 is smaller than the side surface portion 16S. Between the end surface side core 14 and the side surface portion 16S, a part of the outer peripheral side core 13 enters.

Next, referring to FIGS. 29 to 32, the description will be made about a manufacturing method of the coil component 10 of FIG. 27.

Figure 29:
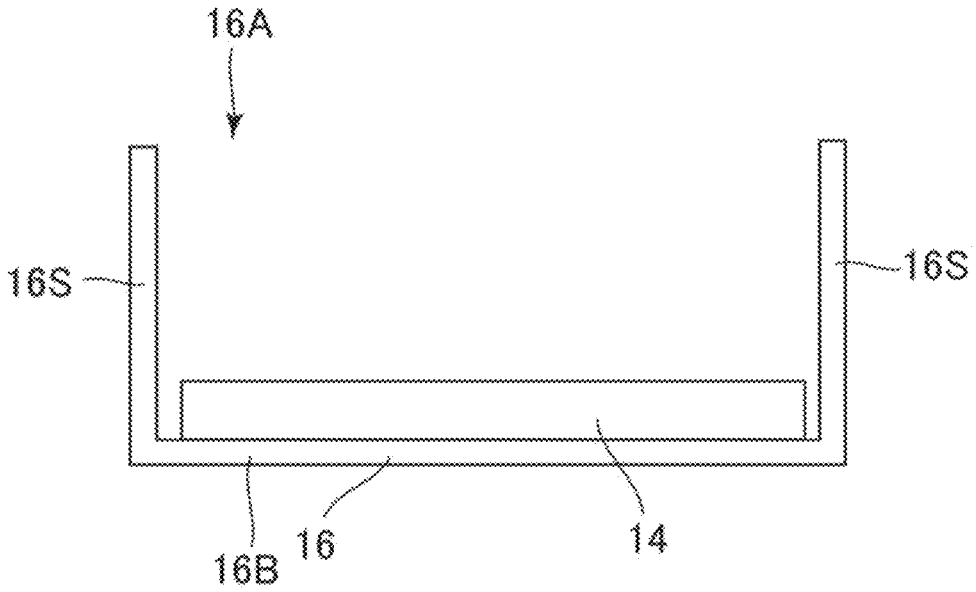
FIG. 29 is a diagram for describing a step of a manufacturing process of the coil component shown in FIG. 27.

First, as shown in FIG. 29, the case 16 is provided, and one of the end surface side cores 14 is put on the bottom portion 16B. Since the end surface side core 14 has the size smaller than that of the side surface portion 16S of the case 16, a gap is formed between the side surface portion 16S and the end surface side core 14. Due to the design like this, it is nothing that a positional relationship between the end surface side core 14 and the case 16 becomes a problem even when the end surface side core 14 has variations in size.

Figure 30:
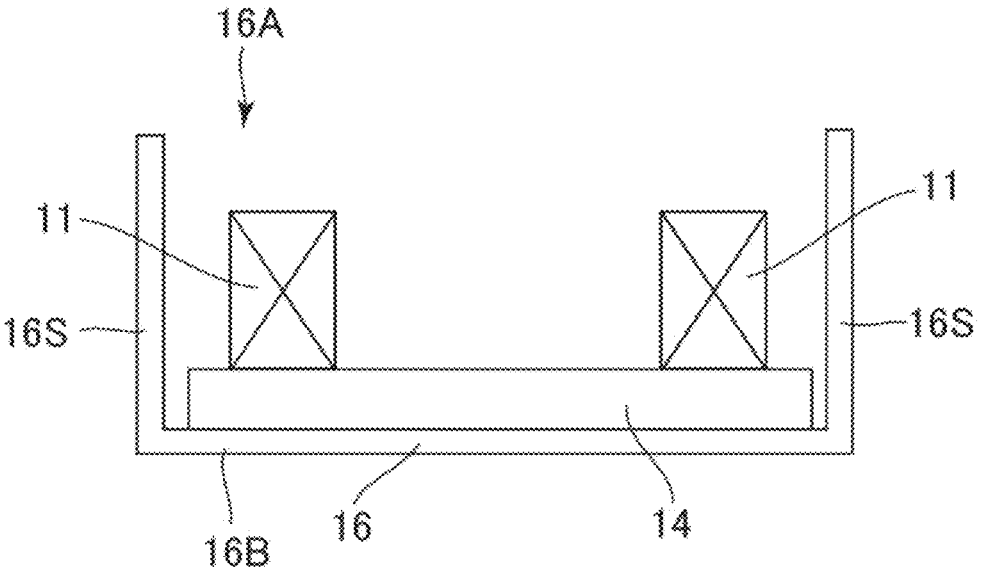
FIG. 30 is a diagram for describing a step succeeding the step of FIG. 29.

Next, as shown in FIG. 30, the coil 11 is put on a surface of one of the end surface side cores 14.

Figure 31:
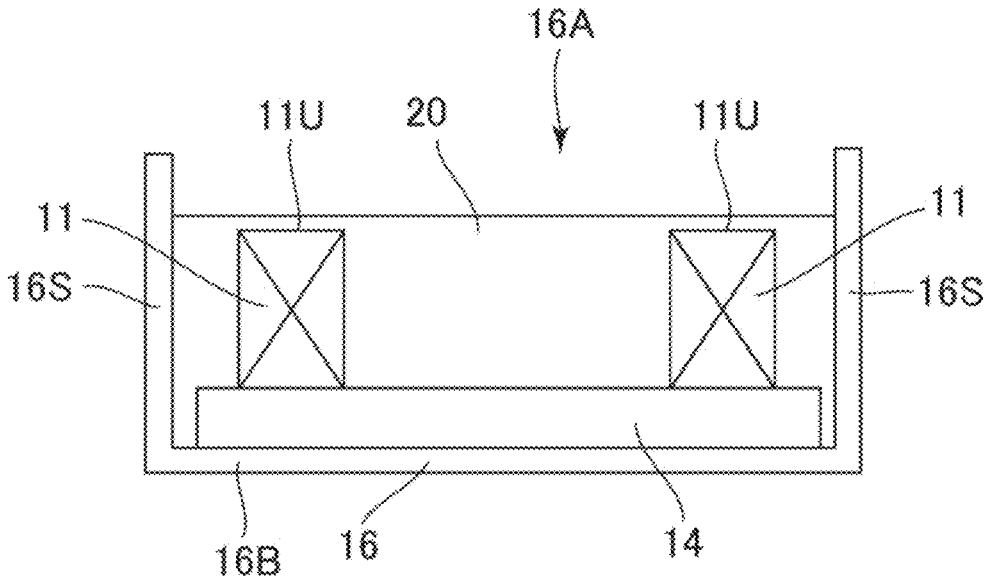
FIG. 31 is a diagram for describing a step succeeding the step of FIG. 30.

Next, as shown in FIG. 31, the slurry 20 which is the material for the inner peripheral side core 12 and the outer peripheral side core 13 is poured into the case 16 though the opening 16A until the coil 11 is immersed. That is, in the present embodiment, an upper surface (liquid surface) of the slurry 20 poured is positioned upper than an upper end 11U of the coil 11. The slurry 20 positioned upper than the upper end 11U of the coil 11 does not form main portions of the inner peripheral side core 12 and the outer peripheral side core 13 but is excess. Similarly, the slurry 20 entered between the end surface side core 14 and the side surface portion 16S is excess. As mentioned later, however, adhesion between both the inner peripheral side core 12 and the outer peripheral side core 13 and the end surface side core 15 can be improved due to existence of the excess of the slurry 20.

In the present embodiment, the opening 16A opens in the direction of the winding axis of the coil 11, so that spaces of the inner side and the outer side of the coil can be seen, and the slurry 20 can be poured to the inner side and the outer side of the coil 11. In other words, in the present embodiment, the opening 16A opens in the direction of the winding axis of the coil 11, so that the inner peripheral side core 12 and the outer peripheral side core 13 can consist of the cast cores.

Figure 32:
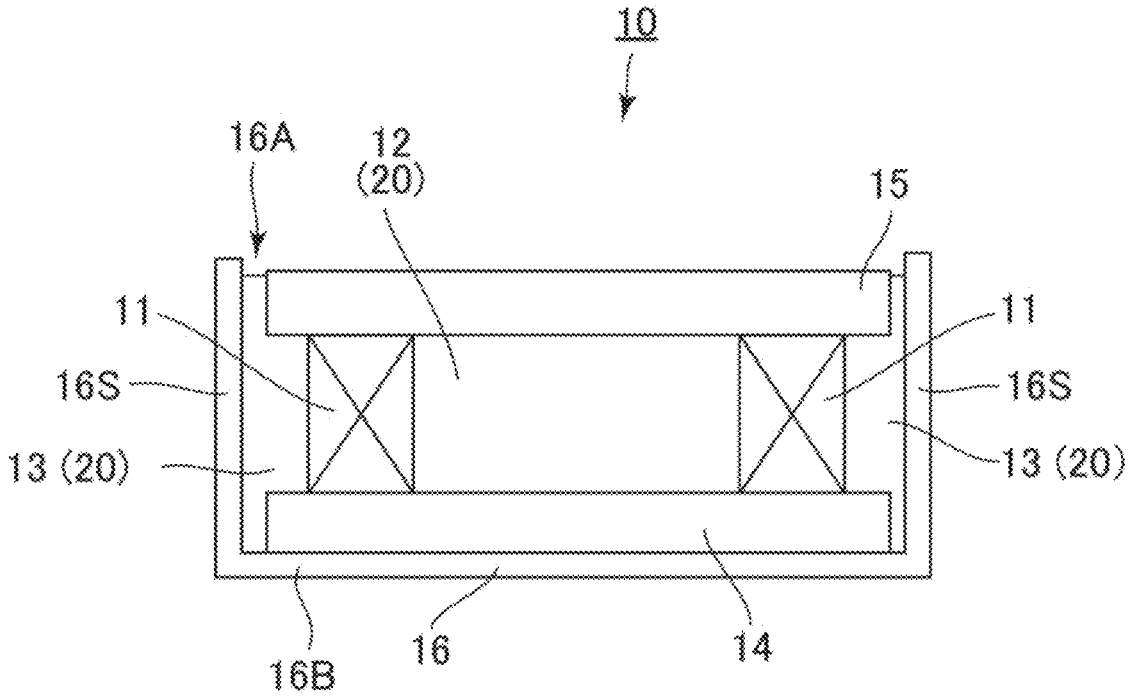
FIG. 32 is a diagram for describing a step succeeding the step of FIG. 31.
Figure 33:
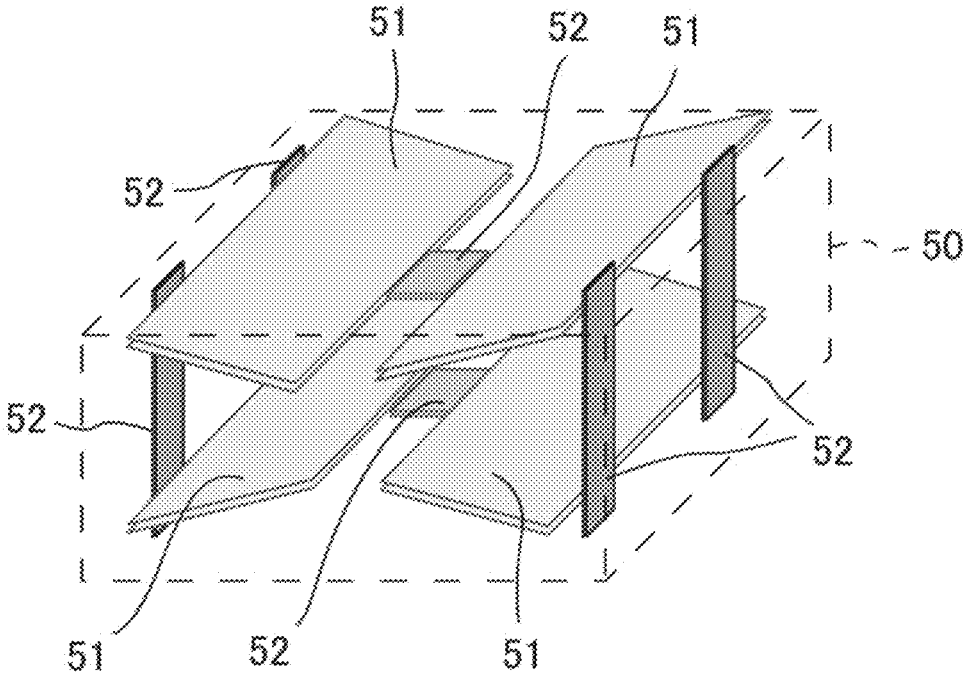
FIG. 33 is a perspective view showing an arrangement example of gap members used in a coil component according to a second embodiment of the present invention.
Figure 34:
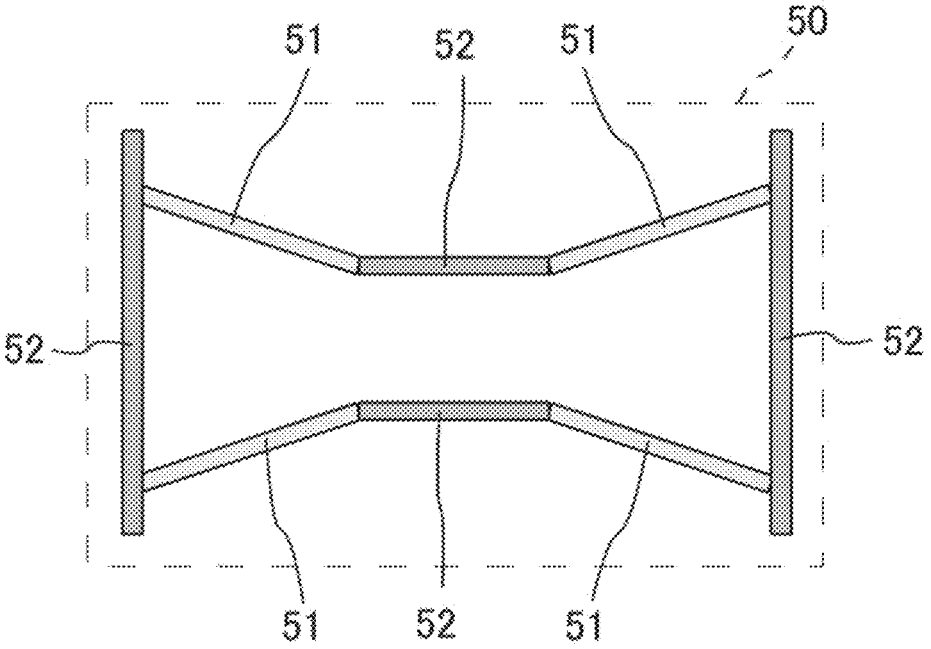
FIG. 34 is a front view showing the arrangement example of the gap members of FIG. 33.
Figure 35:
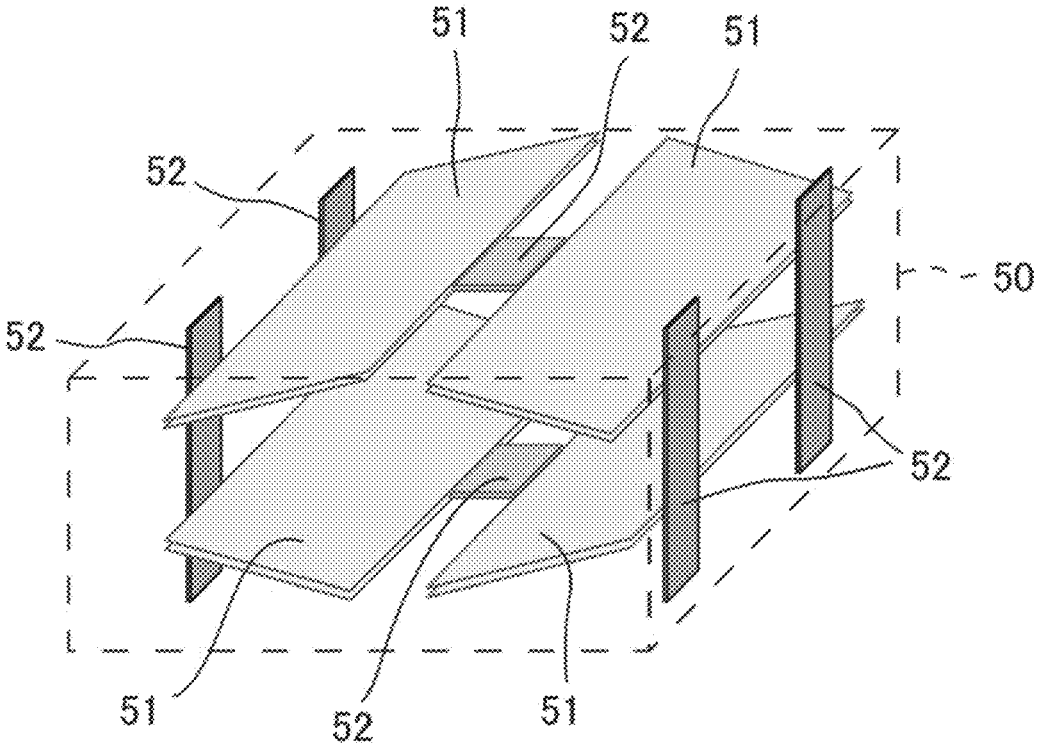
FIG. 35 is a perspective view showing another arrangement example of the gap members used in the coil component according to the second embodiment of the present invention.
Figure 36:
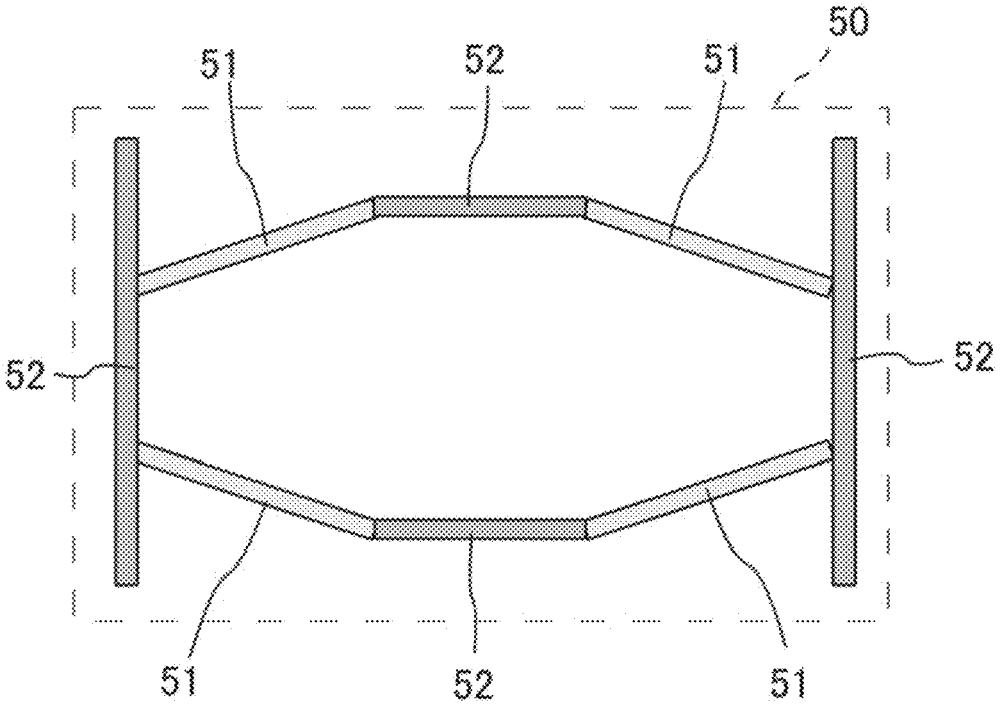
FIG. 36 is a front view showing the arrangement example of the gap members of FIG. 35.

Next, as shown in FIG. 32, the other of the end surface side cores 15 is put on the coil 11. In this time, the other of the end surface side cores 15 is arranged so that the end surface side cores 14 and 15 of the pair are accurately opposed to each other. Since the end surface side core 15 of the present embodiment has the size smaller than that of the side surface portion 16S of the case 16 as mentioned above, a gap is formed between the side surface portion 16S and the end surface side core 14.

When the other of the end surface side cores 15 is pressed toward the bottom portion 16B of the case 16, the excessive slurry 20 enter between the end surface side core 15 and the side surface portion 16S of the case 16. The excessive slurry 20 may reach to an upper surface of the other of the end surface side cores 15 and cover it at least in part. In this condition, the slurry 20 is heated to be hardened. Thus, the slurry 20 is changed to the inner peripheral side core 12 and the outer peripheral side core 13 which are the cast cores. As understood from this, the slurry 20 entered between each of the end surface side cores 14 and 15 and the side surface portion 16S of the case 16 becomes a part of the outer peripheral side core 13. In the present embodiment, in the aforementioned manner, the coil component 10 in which the inner peripheral side core 12 and the outer peripheral side core 13 are in absolute contact with the end surface side cores 14 and 15 and the coil 11 is obtained.

As mentioned above, the present embodiment uses the edgewise coil as the coil 11, arranges the inner peripheral side core 12 and the outer peripheral side core 13 which are the cast cores at the inner side of the inner periphery and the outer side of the outer periphery of the coil, respectively, and couples the inner peripheral side core 12 to the outer peripheral side core 13 with the end surface side cores 14 and 15 which are the dust cores. Thus, the alternating current copper loss caused in the coil 11 can be reduced. Since the cast cores are used as both of the inner peripheral side core 12 and the outer peripheral side core 13, inductance at the zero magnetic field obtained by not applying direct superposition current to the coil component 10 is suppressed to improve direct current superimposition characteristics.

In the present embodiment, a part of the core (specifically, the inner peripheral side core 12 and the outer peripheral side core 13) is formed by using the slurry 20. Thus, a gap between the coil 11 and the core in the vicinity thereof (the inner peripheral side core 12, the outer peripheral side core 13 and the end surface side cores 14 and 15) can be eliminated. Consequently, variation of characteristics of the coil component 10 that depends on assembling accuracy can be reduced or eliminated, rattling of the coil 11 can be suppressed, and noise caused in use of the coil component 10 can be reduced. Furthermore, the present embodiment can reduce the number of dust cores which are solid bodies, thereby simplifying the assembly process. In addition, since the number of dust cores with relatively high magnetic permeability is reduced to use cast cores with relatively low magnetic permeability in the present embodiment, the cost can be reduced.

Although the coil 11 has the rounded quadrangular shape in the plane perpendicular to the winding axis in the aforementioned embodiment, the present invention is not limited thereto. The coil 11 may have an outer shape of a circular, an ellipse or an athletic track shape in the plane perpendicular to the winding axis of the coil.

In the aforementioned embodiment, the cast cores are used as the inner peripheral side core 12 and the outer peripheral side core 13 while the dust cores are used as the end surface side cores 14 and 15. However, dust cores may be used as the inner peripheral side core 12 and the outer peripheral side core 13, and cast cores may be used as the end surface side cores 14 and 15. Alternately, these cores may be formed by impregnating a resin into a molded magnetic body powder and then hardening the resin. At any rate, it is enough that the inner peripheral side core 12, the outer peripheral side core 13 and the end surface side cores 14 and 15 are formed so that the magnetic permeability of the end surface side cores 14 and 15 at the zero magnetic field is higher than the magnetic permeability of the inner peripheral side core 12 and the outer peripheral side core 13 at the zero magnetic field.

Second Embodiment

In addition to the structure of the coil component 10 of the aforementioned first embodiment, as shown in FIGS. 33 and 34 or FIGS. 35 and 36, nonmagnetic gap members 51 are arranged in an inner peripheral side space 50 of the coil 11. That is, four rectangular board shaped gap members 51 are arranged in upper and lower stages of every two. The gap members 51 in each stage are arranged so that long sides of them are parallel to each other. The gap members 51 are fixed to each other with support members 52 to facilitate its assembly. In order to facilitate its assembly and suppress occurrence of alternating current copper loss, the gap members 51 may be arranged to form a predetermined interval between those and the inner circumferential surface of the coil 11. Furthermore, in order to facilitate pouring the slurry 20 in the manufacturing process and to improve the direct current interposition characteristics (reduce the inductance at the zero magnetic field), the gap members 51 adjacent to each other in a right-left direction may be arranged apart from each other. Furthermore, each of the gap members 51 is arranged to be inclined with respect to the plane perpendicular to the winding axis of the coil 11 to facilitate discharging bubbles possible to be generated by pouring the slurry 20. The shape, the number, and the arrangement of the gap members 51 are not limited to the present embodiment. The shape, the number, and the arrangement of the gap members 51 are adjustable according to desired characteristics.

Third Embodiment

Figure 37:
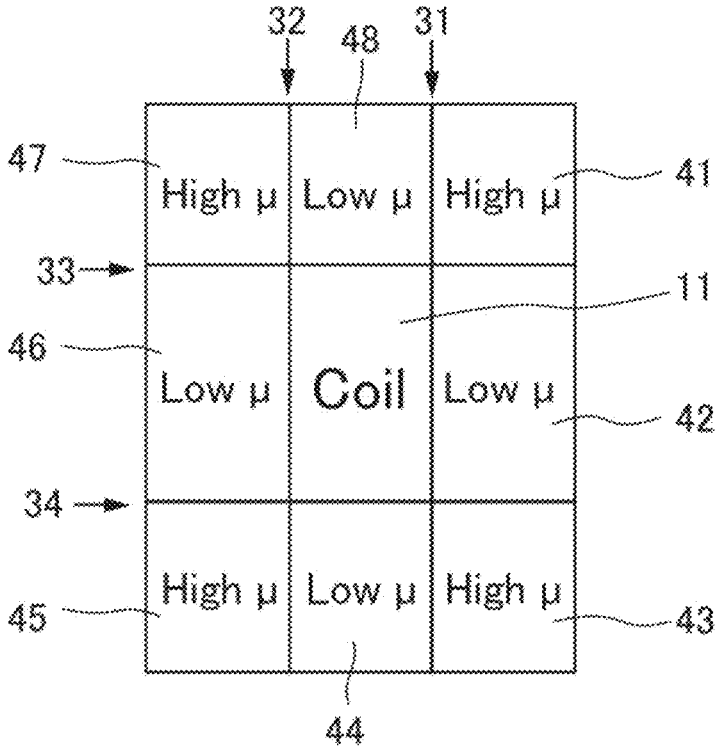
FIG. 37 is a diagram for describing a structure of a coil component according to a third embodiment of the present invention.

Each of the end surface side cores 14 and 15 of the coil component 10 according to the first embodiment is replaced with a cast core (low μ) in part. Specifically, a portion of each of the end surface side cores 14 and 15 that covers the end surface of the coil 11 is replaced with a cast core at least in part. In other words, as shown in FIG. 37, in the cross section obtained by cutting the coil component by the plane including the winding axis of the coil and the magnetic path making a circuit in the core, when the vicinity of the coil 11 (the vicinity of each of two coil sections seen in the cross section of the coil component) is divided into the eight regions 41 to 48 by the four straight lines 31 to 34 extending along the inner circumferential surface, the outer circumferential surface and the end surfaces, the dust cores (first core members, high μ) are respectively disposed in the four regions 41, 43, 45 and 47 positioned at the corners thereof. Moreover, the cast cores (second core members, low μ) are disposed in the region 42 positioned at the inner side of the inner circumferential surface of the coil 11 and the region 46 positioned at the outer side of the outer circumferential surface, respectively. Furthermore, the cast core (third core member, low μ) is disposed in at least a part of each of the regions 44 and 48 positioned at the outer sides of the end surfaces. To remaining parts of the regions 44 and 48, the dust cores are disposed. In each of the regions 44 and 48, the cast core is generally disposed to be interposed between a pair of dust cores. The dust core disposed in each of the regions 44 and 48 may be integrally formed together with the dust core disposed in any one of the regions 41, 43, 45, and 47 adjacent thereto.

Also in this structure, magnetic fluxes are caused and tend to go from one of end surface side cores toward the other of the end surface side cores without passing through the coil 11, so that the magnetic flux leak to the coil 11 is small, obtaining reduction effect of alternating current copper loss. Moreover, this structure has an effect of reducing stress. Moreover, because the inductance at the zero magnetic field is lower than that of the first embodiment, it can be adjusted according to intended use. Also in the present embodiment, according to required characteristics, the gap members 51 described in the second embodiment may be arranged at the inner side of the inner periphery of the coil 11.

Fourth Embodiment

Figure 38:
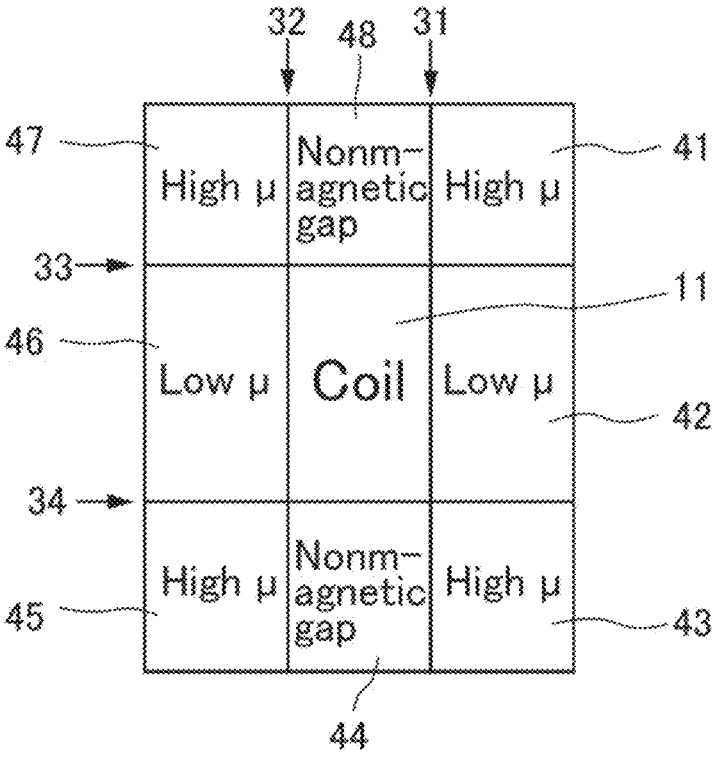
FIG. 38 is a diagram for describing a structure of a coil component according to a fourth embodiment of the present invention.
Figure 39:
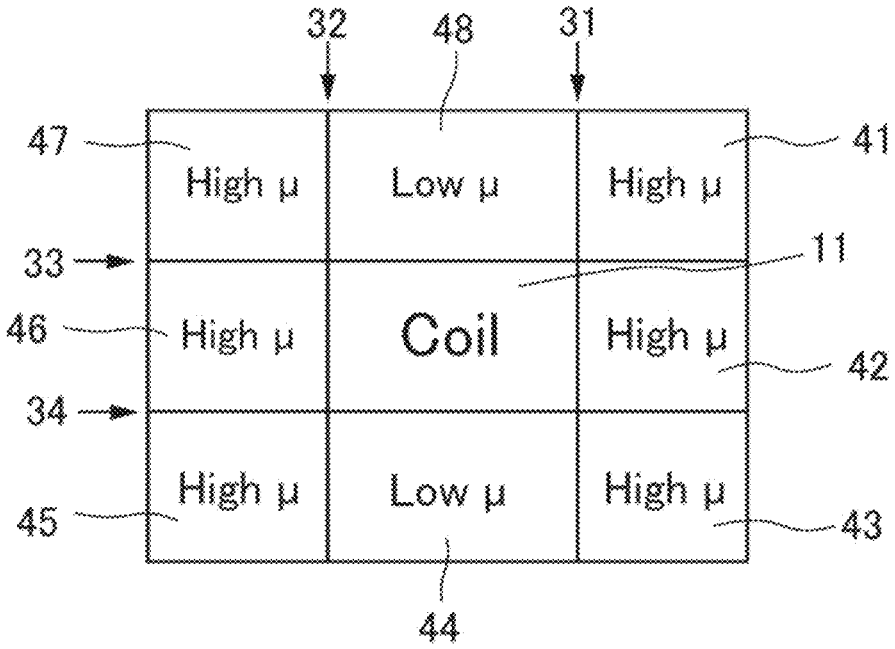
FIG. 39 is a diagram for describing a structure of a coil component according to a fifth embodiment of the present invention.

Each of the end surface side cores 14 and 15 of the coil component 10 according to the first embodiment is replaced with a nonmagnetic gap member in part. Specifically, at least a part of a portion covering the end surface of the coil 11 is replaced with a nonmagnetic gap member. In other words, as shown in FIG. 38, in the cross section obtained by cutting the coil component by the plane including the winding axis of the coil 11 and the magnetic path making a circuit in the core, when the vicinity of the coil 11 (the vicinity of each of the two coil sections seen in the cross section of the coil component) is divided into the eight regions 41 to 48 by the four straight lines 31 to 34 extending along the inner circumferential surface, the outer circumferential surface and the end surfaces, the dust cores (first core members, high μ) are respectively disposed in the four regions 41, 43, 45 and 47 positioned at the corners thereof. Moreover, the cast cores (second core members, low μ) are disposed in the region 42 positioned at the inner side of the inner circumferential surface of the coil 11 and the region 46 positioned at the outer side of the outer circumferential surface, respectively. Furthermore, the nonmagnetic gap member is arranged in at least a part of each of the regions 44 and 48 positioned at the outer side of the end surface of the coil 11. In the figure, though it seems that the whole of each of the end surfaces is covered with the nonmagnetic gap member, the most part of the end surface of the coil 11 is covered with the dust core (third core member, high μ), and a region covered with the nonmagnetic gap member is small. In this structure, by the use of the edgewise coil, the magnetic flux leak from the nonmagnetic gap member to the coil 11 can be suppressed. This is because the end surface of the coil 11 is positioned at a side of the long side of the flat wire in section. Also in the present embodiment, similarly to the third embodiment, the gap members 51 described in the second embodiment may be arranged at the inner side of the inner periphery of the coil 11.

Fifth Embodiment

Figure 40:
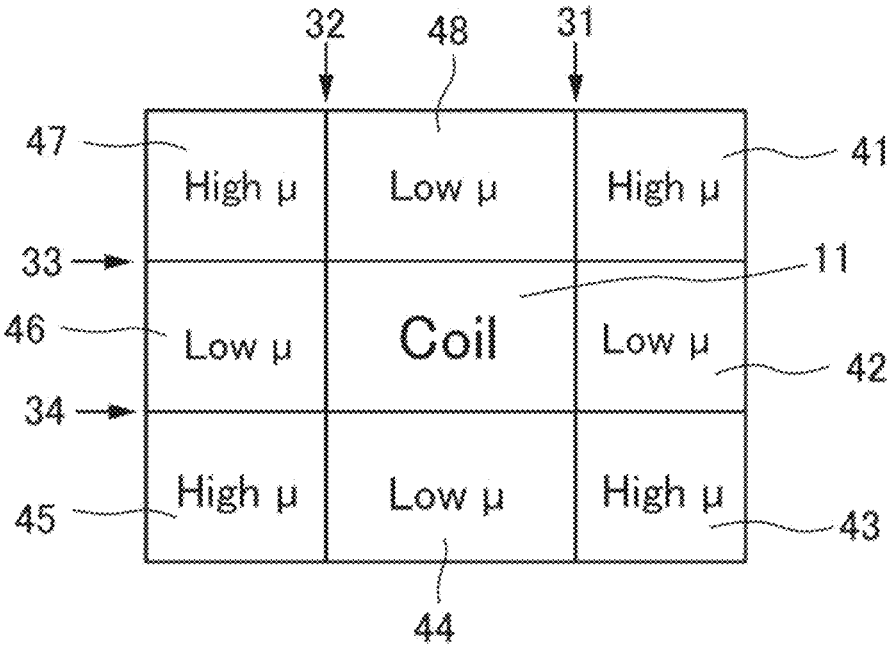
FIG. 40 is a diagram for describing a structure of a coil component according to a sixth embodiment of the present invention.

Although attention is paid to the magnetic field along the winding axis of the coil 11 in the aforementioned first to fourth embodiments, the present embodiment pays attention to a magnetic field of a direction (radial direction) perpendicular to the winding axis of the coil. Then, in the present embodiment, dust cores each of which projects outward of the end surface are disposed at the inner side of the inner periphery and the outer side of the outer periphery, respectively. Moreover, the flatwise coil is used as the coil 11. In other words, as shown in FIG. 40, in the cross section obtained by cutting the coil component by the plane including the winding axis of the coil and the magnetic path making a circuit in the core, when the vicinity of the coil 11 (the vicinity of each of the two coil sections seen in the cross section of the coil component) is divided into the eight regions 41 to 48 by the four straight lines 31 to 34 extending along the inner circumferential surface, the outer circumferential surface and the end surfaces, the dust cores (first core members, high μ) are respectively disposed in the four regions 41, 43, 45 and 47 positioned at the corners thereof. Moreover, the dust cores (second core members, high μ) are disposed also in the region 42 positioned at the inner side of the inner circumferential surface of the coil 11 and the region 46 positioned at the outer side of the outer circumferential surface, respectively. Furthermore, the cast cores (third core member, low μ) are disposed in the regions 44 and 48 positioned at the outer sides of the end surfaces, respectively. The dust core disposed in the region 42 may be integrally formed together with the dust core disposed in each of the regions 41 and 43 adjacent thereto. Similarly, the dust core disposed in the region 46 may be integrally formed together with the dust core disposed in each of the regions 45 and 47 adjacent thereto. Also in the present embodiment, the magnetic flux leak to the coil 11 is little, obtaining a reduction effect for the alternating current copper loss.

Sixth Embodiment

The inner peripheral side core 12 and the outer peripheral side core 13 of the coil component according to the fifth embodiment are replaced with cast cores. That is, as shown in FIG. 40, in the cross section obtained by cutting the coil component by the plane including the winding axis of the coil and the magnetic path making a circuit in the core, when the vicinity of the coil 11 (the vicinity of each of the two coil sections seen in the cross section of the coil component) is divided into the eight regions 41 to 48 by the four straight lines 31 to 34 extending along the inner circumferential surface, the outer circumferential surface and the end surfaces, the dust cores (first core members, high μ) are respectively disposed in the four regions 41, 43, 45 and 47 positioned at the corners thereof. Moreover, the cast core (second core member, low μ) is disposed in at least a part of each of the region 42 positioned at the inner side of the inner circumferential surface of the coil 11 and the region 46 positioned at the outer side of the outer circumferential surface. Furthermore, the cast cores (third core members, low μ) are disposed in the regions 44 and 48 positioned at the outer sides of the end surfaces, respectively. To remaining parts of the regions 42 and 46, the dust cores are disposed. In each of the regions 42 and 46, the cast core is generally disposed to be interposed between a pair of dust cores. The dust core disposed in each of the regions 42 and 46 may be integrally formed together with the dust core disposed in any one of the regions 41, 43, 45 and 47 adjacent thereto. Also in the present embodiment, the magnetic flux leak to the coil 11 is little, obtaining a reduction effect for the alternating current copper loss.

Although the specific explanation about the present invention is made above referring to the embodiments, the present invention is not limited thereto but susceptible of various modifications and alternative forms. For example, the coil 11 may be a coil into which a square wire or a round wire is wound though the edgewise coil or the flatwise coil is used as the coil 11 in the aforementioned embodiments. Moreover, each of the number of winding rows and the number of layers of the coil may be greater than or equal to two. In a case where dust cores are used as the end surface side cores 14 and 15, however, the number of winding rows of the coil is preferably smaller than or equal to 10, especially preferably smaller than or equal to 2. Similarly, in a case where dust cores, which protrude outward of the end surfaces, are used at an inner side of an inner circumferential surface and an outer side of the outer circumferential surface of the coil, respectively, the number of layers of the coil is preferably smaller than or equal to 10, especially preferably smaller than or equal to 2. Moreover, although the region in the vicinity of the coil is divided into eight by straight lines along the inner circumferential surface, the outer circumferential surface and the end surfaces, some differences are allowed. For example, in FIG. 28, each of the four regions positioned at corners may protrude toward a side of the cast core (low μ) (in up-down direction). In this case, amount of the protrusion is desirable to be 10% or less of the thickness of the dust core in the up-down direction. This is because large amount of the protrusion facilitates occurrence of the magnetic flux leak (forming magnetic path not interlinking the coil) at the corner portion of the coil. The protruding portion can be used for positioning in the assembly process or the like. Although the coil component of the present invention is suitable for a reactor, especially a reactor for car, it is applicable to other coil components.

The present invention is based on Japanese Patent Applications No. 2015-164925 filed on Aug. 24, 2015, and the contents of which form a part of the present specification by reference.

While the best embodiments of the present invention have been described, as it is apparent to those skilled in the art, the embodiments are possible to be modified within a scope that is not departing from the spirit of the present invention, and such embodiments belong to the scope of the present invention.

REFERENCE SIGNS LIST

10 Coil Component
11 Coil
12 Inner Peripheral Side Core
13 Outer Peripheral Side Core
14, 15 End surface Side Core
16 Case
16A Opening
16B Bottom Portion
16S Side Surface Portion
20 Slurry
31 Straight Line along Inner circumferential surface
32 Straight Line along Outer circumferential surface
33,34 Straight Line along End surface
41-48 Region
50 Inner Peripheral Side Space
51 Nonmagnetic Gap Member
52 Support Member
111, 131, 151 Coil
112, 122, 132, 142, 152, 162 Magnetic Flux
113, 123, 133, 143, 153, 163 Large Alternating Current Copper Loss Region
171, 201 Conducting Wire
172, 174, 202, 204 Core
173, 203 Magnetic Flux
231 Edgewise Coil
232 Lower Core
233 Upper Core
234, 235 Large Alternating Current Copper Loss Region
241, 251, 261, 271 Edgewise Coil
242, 264 Dust Core
243 Gap
244, 253, 265, 282, 283, 292, 293, 302, 303 Region
245, 254, 255, 266, 276, 284, 294 Large Alternating Current Copper Loss Region
252, 262, 263 Cast Core
281, 291 Coil
301 Flatwise Coil

The invention claimed is:

1. A coil component comprising:

a coil having an inner circumferential surface, an outer circumferential surface and a pair of end surfaces continuous with the inner circumferential surface and the outer circumferential surface;

a core surrounding at least a part of a periphery of the coil; and a case accommodating the coil and the core, wherein:

in a cross section in which the coil is cut by a plane including a winding axis of the coil and a magnetic path making a circuit in the core, when a vicinity of each of coil sections is divided into eight regions by four straight lines extending along the inner circumferential surface, the outer circumferential surface and the end surfaces, the core includes: first core members which are disposed in four of the regions positioned at corners, respectively, second core members which are disposed in two of the regions positioned at an inner side of the inner circumferential surface and an outer side of the outer circumferential surface, respectively, and third core members which are disposed in two of the regions positioned at outer sides of the end surfaces, respectively, at least one of the second core members and the third core members has a magnetic permeability lower than that of the first core members in a zero magnetic field, the case has a side surface portion, between 1) one of the first core members which is located closer to the outer circumferential surface than the inner circumferential surface and 2) the side surface potion of the case, an additional core member having a magnetic permeability lower than that of the first core members in a zero magnetic field is arranged, and the additional core member physically contacts the one of the first core members that is located closer to the outer circumferential surface than the inner circumferential surface.

2. The coil component as recited in claim 1, wherein:

the second core member has a magnetic permeability lower than that of the first core member in a zero magnetic field; and at least a part of the third core member is made of a material identical to that of the second core member.

3. The coil component as recited in claim 1, wherein:

the second core members have a magnetic permeability lower than that of the first core members in a zero magnetic field; and the third core members are made of a material identical to that of the first core members.

4. The coil component as recited in claim 3, wherein a nonmagnetic gap is inserted into the second core member disposed at the inner side of an inner periphery of the coil.

5. The coil component as recited in claim 3, wherein at least a part of the third core member is replaced by a nonmagnetic gap.

6. The coil component as recited in claim 3, wherein the coil is an edgewise coil into which a flat wire is wound in a helical fashion.

7. The coil component as recited in claim 6, wherein the flat wire has a thickness greater than a skin depth.

8. The coil component as recited in claim 6, wherein the coil is smaller than or equal to 10 in number of winding rows.

9. The coil component as recited in claim 8, wherein the coil is smaller than or equal to 2 in number of the winding rows.

10. The coil component as recited in claim 3, wherein:

each of the first core members is a dust core; and each of the second core members is obtained by hardening a mixture of a magnetic substance and a resin.

11. The coil component as recited in claim 1, wherein:

the third core member has a magnetic permeability lower than that of the first core member in a zero magnetic field; and at least a part of the second core member is made of a material identical to that of the third core member.

12. The coil component as recited in claim 1, wherein:

the third core member has a magnetic permeability lower than that of the first core member in a zero magnetic field; and the second core member is made of a material identical to that of the first core member.

13. The coil component as recited in claim 12, wherein the coil is a flatwise coil into which a flat wire is wound in a spiral fashion.

* * * * *